US008757056B2

(12) United States Patent
Kohno

(10) Patent No.: US 8,757,056 B2
(45) Date of Patent: Jun. 24, 2014

(54) DIE CUSHION DEVICE FOR PRESS MACHINE

(75) Inventor: Yasuyuki Kohno, Kanagawa (JP)

(73) Assignee: Aida Engineering, Ltd., Kanagawa (JP)

( * ) Notice: Subject to any disclaimer, the term of this patent is extended or adjusted under 35 U.S.C. 154(b) by 429 days.

(21) Appl. No.: 13/129,688

(22) PCT Filed: Nov. 9, 2009

(86) PCT No.: PCT/JP2009/069036
§ 371 (c)(1),
(2), (4) Date: May 17, 2011

(87) PCT Pub. No.: WO2010/058710
PCT Pub. Date: May 27, 2010

(65) Prior Publication Data

US 2011/0226141 A1 Sep. 22, 2011

(30) Foreign Application Priority Data

Nov. 18, 2008 (JP) ..... 2008-294752

(51) Int. Cl.
*B21D 24/02* (2006.01)
*B21D 24/14* (2006.01)

(52) U.S. Cl.
CPC ..... *B21D 24/02* (2013.01); *B21D 24/14* (2013.01)
USPC ..... 100/50; 100/269.01; 72/453.13

(58) Field of Classification Search
CPC ..... B21D 24/02; B21D 24/14
USPC ..... 100/269.18, 918, 50, 269.01; 72/350, 72/351, 453.13, 455; 267/119, 130, 140, 267/152, 153; 248/633
See application file for complete search history.

(56) References Cited

U.S. PATENT DOCUMENTS 5,065,606 A * 11/1991 Kadis ..... 72/348
5,140,895 A 8/1992 Imanishi (Continued)

FOREIGN PATENT DOCUMENTS

CN 101175585 A 5/2008
DE 690 07 737 T2 7/1994

(Continued)

OTHER PUBLICATIONS

International Application No. PCT/JP2009/069036: Preliminary Report on Patentability, dated Jun. 21, 2011.

(Continued)

*Primary Examiner* — Jimmy T Nguyen
(74) *Attorney, Agent, or Firm* — McDermott Will & Emery LLP

(57) ABSTRACT

A die cushion device for a press machine includes: a hydraulic cylinder for supporting a cushion pad and generating a die cushion pressure when a slide of the press machine moves downward; a proportional valve and a hydraulic pump/motor connected in parallel between a lower chamber of the hydraulic cylinder and a low-pressure source; an electric motor connected to a rotating shaft of the hydraulic pump/motor; a die cushion pressure command issuer for outputting a predetermined die cushion pressure command; a pressure detector for detecting a pressure in the lower chamber of the hydraulic cylinder; and a controller for controlling an aperture of the proportional valve and a torque of the electric motor in a manner that the die cushion pressure becomes equal to a pressure corresponding to the die cushion pressure command, based on the die cushion pressure command and the pressure detected by the pressure detector.

14 Claims, 15 Drawing Sheets

(56) References Cited

U.S. PATENT DOCUMENTS

| | | | | |
|---|---|---|---|---|
| 5,299,444 | A * | 4/1994 | Kirii et al. | 72/453.13 |
| 5,339,665 | A * | 8/1994 | Yoshikawa | 72/20.1 |
| 5,435,166 | A * | 7/1995 | Sunada | 72/351 |
| 7,197,910 | B2 * | 4/2007 | Kodani | 72/453.13 |
| 2006/0254337 | A1 | 11/2006 | Arns et al. | |
| 2009/0071218 | A1 * | 3/2009 | Kohno et al. | 72/351 |
| 2009/0158810 | A1 | 6/2009 | Kohno et al. | |

FOREIGN PATENT DOCUMENTS

| | | | |
|---|---|---|---|
| DE | 103 36 279 | A1 | 3/2005 |
| EP | 1656224 | B1 | 5/2006 |
| EP | 1882534 | A1 | 1/2008 |
| JP | 64-54919 | U | 4/1989 |
| JP | 3-133599 | A | 6/1991 |
| JP | 6-335947 | A | 12/1994 |
| JP | 2006-142312 | A | 6/2006 |
| JP | 2006-315074 | A | 11/2006 |
| JP | 2007-507349 | A | 3/2007 |
| WO | 2005/016571 | A1 | 2/2005 |
| WO | 2006/123452 | A1 | 11/2006 |

OTHER PUBLICATIONS

Chinese Office Action with English Translation issued in Chinese Appliction No. 200980146040.4 dated Nov. 13, 2012.

* cited by examiner

DIE CUSHION DEVICE FOR PRESS MACHINE

CROSS REFERENCE TO PRIOR APPLICATIONS

This application is a U.S. National Phase application under 35 U.S.C. §371 of International Application No. PCT/JP2009/069036, filed on Nov. 9, 2009 and claims benefit of priority to Japanese Patent Application No. 2008-294752, filed on Nov. 18, 2008. The International Application was published in Japanese on May 27, 2010 as WO 2010/058710 A1 under PCT Article 21(2). All these applications are herein incorporated by reference.

TECHNICAL FIELD

The present invention generally relates to die cushion devices for press machines, and more particularly, to a die cushion device for a press machine that can cope with high-speed operations of the press machine, can have a smaller size, and can be provided at a lower price.

BACKGROUND ART (a) Die Cushion Device of Hydraulic (Servo) Type

PTL 1 discloses a die cushion device of a hydraulic servo type that performs throttle control with a proportional valve.

In this die cushion device, a proportional valve is placed on the lower chamber side of a hydraulic cylinder supporting a cushion pad, and a desired die cushion pressure is generated by controlling the proportional valve to have an appropriate aperture.

This die cushion device has the advantages that: the die cushion pressure can be controlled with the use of the proportional valve or the like; a pressure change can be caused as needed; and the diameter of the hydraulic cylinder can be smaller, which implements a pit-less device or smaller devices, since the die cushion device can be used at a relatively high pressure.

On the other hand, this die cushion device has the disadvantage that all the energy used for the die cushioning function is converted into heat, since a pressure is generated by reducing the oil flow. Also, it is necessary to prepare a cooling function (a cooling system) that is compatible with the capability of the device, though using such a cooling system is considered a waste, in view of the environmental friendliness. This applies to devices of all hydraulic types. When the slide velocity is low during a die cushioning operation, compression of the oil in the hydraulic cylinder becomes slower, and the booster responsiveness is more likely to become lower (the boosting time tends to become longer).

(b) Die Cushion Device of Electric (Servo) Type

PTL 2 discloses a die cushion device of an electric servo type.

In this die cushion device, the discharge outlet of a hydraulic pump/motor is connected directly to the lower chamber of a hydraulic cylinder supporting a cushion pad. The torque of an electric motor connected to the rotating shaft of the hydraulic pump/motor is controlled, and the pressure in the lower chamber of the hydraulic cylinder (the die cushion pressure) can be freely controlled.

This die cushion device has an advantage that the energy required for the die cushioning function to which the cushion pad is subjected when the press machine executes the die cushioning function is regenerated as an electric energy via the hydraulic cylinder, the hydraulic pump/motor, and an electric motor, and accordingly, a higher energy efficiency is achieved. In addition, even if the slide velocity is low, the die cushion pressure can be suitably controlled, and a higher pressure controllability than that of a die cushion device of a hydraulic (servo) type can be achieved.

On the other hand, this die cushion device has a disadvantage that a large-capacity electric motor is required to generate the necessary power for the die cushioning function at the same time when the die cushioning function is performed. If the electric motor has a larger capacity, the device becomes larger in size, and the power receiving facilities also require a large capacity. As a result, the system inevitably becomes complicated, and the price becomes higher. Therefore, the die cushion device of the electric servo type is an inefficient device in terms of capital investment, though such a die cushion device has a high energy efficiency.

In addition, in order to release the oil pushed away (displaced) from the hydraulic cylinder to the low-pressure side via the hydraulic pump/motor (and the electric motor) at the time of impact, the angular velocity of the motor (the inertia moment) needs to be rapidly accelerated by the displaced oil, and a surge pressure is easily generated as a reaction to the acceleration.

CITATION LIST

Patent Literature

PTL 1: Japanese Patent Application Laid-Open No. 2006-142312

PTL 2: Japanese Patent Application Laid-Open No. 2006-315074

SUMMARY OF INVENTION

Technical Problem

The conventional die cushion devices disclosed in PTL 1 and 2 have both advantages and disadvantages.

The present invention is made to combine many advantages of the die cushion device of the hydraulic servo type that performs throttle control with a proportional valve as disclosed in PTL 1, and of the die cushion device of the electric servo type disclosed in PTL 2, while resolving and eliminating the disadvantages of the die cushion devices.

The present invention aims to provide a die cushion device for a press machine that can improve the die cushion pressure controllability without generation of a surge pressure, regardless of the slide velocity, has high energy efficiency by virtue of an energy regenerating function, and can realize downsizing and price reduction.

Solution to Problem

To achieve the above objects, a die cushion device for a press machine of a first aspect of the present invention includes: a hydraulic cylinder for supporting a cushion pad and generating a die cushion pressure when a slide of the press machine moves downward; a proportional valve and a hydraulic pump/motor connected in parallel between a lower chamber of the hydraulic cylinder and a low-pressure source; an electric motor connected to a rotating shaft of the hydraulic pump/motor; a die cushion pressure command issuer for outputting a predetermined die cushion pressure command; a pressure detector for detecting a pressure in the lower chamber of the hydraulic cylinder; and a controller for controlling an aperture of the proportional valve and a torque of the electric motor in a manner that the die cushion pressure becomes equal to a pressure corresponding to the die cushion pressure command, based on the die cushion pressure command and the pressure detected by the pressure detector.

The invention according to claim 1 involves both a control function of a hydraulic servo type that performs throttle control with a proportional valve, and a control function of an electric servo type that uses a hydraulic pump/motor (and an electric motor). The aperture of the proportional valve and the torque of the electric motor are controlled in a manner that the die cushion pressure becomes equal to a pressure corresponding to the die cushion pressure command. Particularly, when a die cushioning function is performed, the liquid displaced from the lower chamber of the hydraulic cylinder can be released to the low-pressure source side via the proportional valve and the hydraulic pump/motor. Accordingly, the electric motor can have a smaller capacity than in a case where the die cushion pressure is controlled solely by an electric motor (and a hydraulic pump/motor). As a result, the device can be made smaller in size and less expensive.

The quantity of liquid discharged from the proportional valve (by a valve differential pressure) is several times (three to ten times) larger than the quantity of liquid displaced by the hydraulic pump/motor (and the electric motor), with respect to the same price standard and to the same installation space (the device size).

In addition, the quantity of liquid released from the hydraulic pump/motor to the low-pressure source can be reduced by controlling the proportional valve to open beforehand at the time of impact. Accordingly, generation of a surge pressure as the reaction to the acceleration torque required for angularly accelerating the inertia moment of the hydraulic pump/motor (and the electric motor) can be restrained. Even if the slide velocity becomes low while a die cushioning function is being performed, the die cushion pressure can be controlled with a high responsiveness by controlling the torque of the electric motor. Thus, the die cushion pressure controllability can be improved.

In a second aspect of the present invention, the die cushion device for the press machine according to the first aspect of the present invention further includes a regenerating unit for regenerating an energy applied to the hydraulic cylinder when the press machine executes die cushioning function, the energy being used for the die cushioning function, as an electric energy via the hydraulic pump/motor and the electric motor. With this arrangement, the energy efficiency can be made higher than that of a hydraulic servo type (involving only a proportional valve) by which all the energy used for the die cushioning function is converted into heat.

To cope with high-speed operation of pressing, a device of the hydraulic servo type becomes smaller in size, and less expensive (in terms of the initial cost). However, where a die cushion device is formed only by the hydraulic servo system, the energy efficiency is poor due to pressure loss of the proportional valve, and heat is generated. As a result, the running cost becomes higher. In view of the energy efficiency, the electric servo method using the hydraulic pump/motor (and the electric motor) is also employed, and the energy required for the die cushioning function is regenerated as an electric energy, in this manner, the energy efficiency is made higher.

In a third aspect of the present invention, the die cushion device for the press machine according to the first or second aspect of the invention further includes slide velocity detecting means that detects the velocity of the slide. In the third aspect of the present invention, the controller the controller controls the proportional valve based on the velocity detected by the slide velocity detecting means when the velocity is larger than a predetermined value at a time of performing die cushioning function of the press machine, and releases part of a pressure liquid displaced from the hydraulic cylinder to the low-pressure source via the proportional valve. Here, various instruments may be employed as the slide velocity detecting means. For example, it is possible to employ an instrument to detect the slide velocity directly with a sensor, or an instrument to determine the slide velocity by detecting the angular velocity of the crankshaft that moves the slide and performing an arithmetic operation based on the detected angular velocity signal.

Most of the press machines that can cope with high-speed operations are those of mechanical types. Typical examples of them include press machines of a crank mechanism type or an eccentric-gear mechanism type. In the press machines of such types, the slide velocity characteristically becomes lower as the bottom dead point becomes closer, and the slide velocity is zero at the bottom dead point. That is, while molding that requires a die cushioning function is being performed, the slide velocity is high during a very short period of time at the beginning of the molding (at the time of impact with the cushion pad), but becomes unlimitedly lower as the molding progresses and the bottom dead point becomes closer.

If a die cushion device is formed only by the electric servo method using the hydraulic pump/motor (and the electric motor) to cope with cases where the slide velocity is higher than a predetermined value (for a high-speed period that is extremely short) during a die cushioning operation in the above circumstances, the price of the product becomes higher, and the device becomes larger (or becomes overengineered). To counter this problem, the hydraulic servo system by which the aperture of the proportional valve is controlled in synchronization with extremely short high-speed periods is used as well as the hydraulic pump/motor (and the electric servo motor) that operates during most of the molding period. In this manner, a die cushion device that can cope with high-speed operations with a relatively high efficiency can be realized in a small space and at a low price.

When the slide velocity becomes lower than the predetermined value (or when the slide becomes slower), the proportional valve is not used (the aperture is set at zero: a blocked state), and only the electric servo method using the hydraulic pump/motor (and the electric motor) is implemented. Accordingly, large part of the energy required for the die cushioning function can be regenerated as an electric energy, and the die cushion pressure controllability during low-speed operations can be improved.

According to a fourth aspect of the present invention, in the die cushion device for the press machine according to the third aspect of the present invention, the controller controls an aperture of the proportional valve at a time of performing the die cushioning function of the press machine, based on the die cushion pressure command, the pressure detected by the pressure detector, and the velocity detected by the slide velocity detecting means.

In a fifth aspect of the present invention, the die cushion device for the press machine according to any one of the first through fourth aspects of the present invention further includes: slide velocity detecting means for detecting a velocity of the slide; and an angular velocity detector for detecting an angular velocity of one of the hydraulic pump/motor and the electric motor. In the fifth aspect of the invention, the controller controls a torque of the electric motor at a time of performing a die cushioning function of the press machine in a manner that a die cushion pressure becomes equal to a pressure corresponding to the die cushion pressure command, based on the die cushion pressure command, the pressure detected by the pressure detector, the velocity detected by the slide velocity detecting means, and the angular velocity detected by the angular velocity detector.

In a sixth aspect of the present invention, the die cushion device according to any one of the first through fifth aspects of the present invention further includes a slide position detector that detects the position of the slide. In the sixth aspect of the present invention, the die cushion pressure command issuer outputs the die cushion pressure command, based on the slide position detected by the slide position detector.

In a seventh aspect of the present invention, the die cushion device for the press machine according to any one of the first through sixth aspects of the present invention further includes a die cushion position detector that detects the position of the cushion pad. In the seventh aspect of the present invention, the controller uses a die cushion position signal detected by the die cushion position detector as a position feedback signal for controlling the electric motor when a product knockout operation is performed or the hydraulic cylinder is independently moved upward or downward. With this arrangement, the position of the hydraulic cylinder (the cushion pad) can be controlled during a period when pressing (or the die cushioning function) is not performed, and the ascending operation (the product knockout operation) is performed during that period. Here, the knockout operation is the operation to knock a product out of a metal mold.

According to an eighth aspect of the present invention, in the die cushion device for the press machine according to any one of the first through seventh aspects of the present invention, the hydraulic cylinder includes a plurality of hydraulic cylinders arranged in parallel with respect to the cushion pad, and the proportional valve and the hydraulic pump/motor are connected to lower chambers of the respective hydraulic cylinders via a shared pipe.

According to a ninth aspect of the present invention, in the die cushion device for the press machine according to any one of the first through eighth aspects of the present invention, the hydraulic pump/motor includes a plurality of hydraulic pumps/motors each having a pressure liquid supplied from the lower chamber of the hydraulic cylinder via a branch pipe, and the electric motor includes a plurality of electric motors respectively connected to the plurality of hydraulic pumps/motors and subjected to torque control. With this arrangement, each one of the hydraulic pumps/motors and electric motors can be a general-purpose device having a relatively small capacity even in a large-sized press machine.

In a tenth aspect of the present invention, in the die cushion device for the press machine according to any one of the first through ninth aspects of the present invention, the proportional valve includes a plurality of proportional valves to each of which a pressure liquid is provided from the lower chamber of the hydraulic cylinder via a branch pipe, and an aperture of each of the proportional valves is controlled.

According to an eleventh aspect of the present invention, in the die cushion device for the press machine according to any one of the first through third, sixth, ninth, and tenth aspects of the present invention, a plurality of sets of the hydraulic cylinder, the proportional valve, the hydraulic pump/motor, the electric motor, and the pressure detector are provided for the single cushion pad. With this arrangement, the die cushion device can be formed from a plurality of lines of devices arranged in parallel. Also, the capacity of each of the devices (the proportional valves, the hydraulic motors, the electric motors, and the like) can be made smaller, and pressure control can be performed on the respective lines independently of one another.

In a twelfth aspect of the present invention, the die cushion device for the press machine according to the eleventh aspect of the present invention further includes slide velocity detecting means that detects the velocity of the slide. In the twelfth aspect of the present invention, the controller individually controls an aperture of the proportional valve for each hydraulic cylinder at a time of performing die cushioning function of the press machine, based on the die cushion pressure command, the pressure detected by the pressure detector, and the velocity detected by the slide velocity detecting means.

In a thirteenth aspect of the present invention, the die cushion device for the press machine according to the eleventh or twelfth aspect of the present invention further includes: slide velocity detecting means that detects the velocity of the slide; and a plurality of angular velocity detectors that detect the respective angular velocities of the hydraulic pumps/motors or the electric motors. In the thirteenth aspect of the present invention, the controller controls a torque of each of the electric motors at a time of performing die cushioning function of the press machine in a manner that a die cushion pressure in each of the hydraulic cylinders becomes equal to the pressure corresponding to the die cushion pressure command, based on the die cushion pressure command, the velocity detected by the slide velocity detecting means, the respective pressures detected by the pressure detectors, and the respective angular velocities detected by the angular velocity detectors.

In a fourteenth aspect of the present invention, the die cushion device for the press machine according to any one of the eleventh through thirteenth aspects of the present invention further includes a plurality of die cushion position detectors for the respective hydraulic cylinders, and the die cushion position detectors detect the position of the cushion pad. In the fourteenth aspect of the present invention, the controller uses the respective die cushion position signals detected by the die cushion position detectors as position feedback signals for controlling the electric motors driving the corresponding hydraulic cylinders, when a product knockout operation is performed or each of the hydraulic cylinders is independently moved upward or downward.

According to the eleventh through fourteenth aspects of the present invention, the hydraulic cylinders can be controlled independently of one another. Accordingly, even when an eccentric load is applied onto the cushion pad, a die cushion pressure in accordance with the eccentric load can be generated, and position control can be performed to maintain the cushion pad in a horizontal position, regardless of the loads applied when a product knockout operation is performed or the cushion pad is independently moved upward or downward.

Advantageous Effects of Invention

According to the present invention, a proportional valve of the hydraulic servo type and a hydraulic pump/motor (and an electric motor) of the electric servo type are connected in parallel between a low-pressure source and the lower chamber of a hydraulic cylinder that generates a die cushion pressure, and the aperture of the proportional valve and the torque of the electric motor are controlled in a manner that the die cushion pressure becomes equal to a pressure corresponding to a die cushion pressure command. Accordingly, a surge pressure is not generated, and the die cushion pressure controllability can be improved, regardless of the slide velocity. Also, the energy efficiency can be made higher by virtue of the energy regenerating function. Further, the device size can be reduced, and lower prices can be realized.

DESCRIPTION OF EMBODIMENTS

The following is a detailed description of preferred embodiments of die cushion devices for press machines according to the present invention, with reference to the accompanying drawings.

Structure of Die Cushion Device

First Embodiment

<General Drawing Process>

Figure 1:
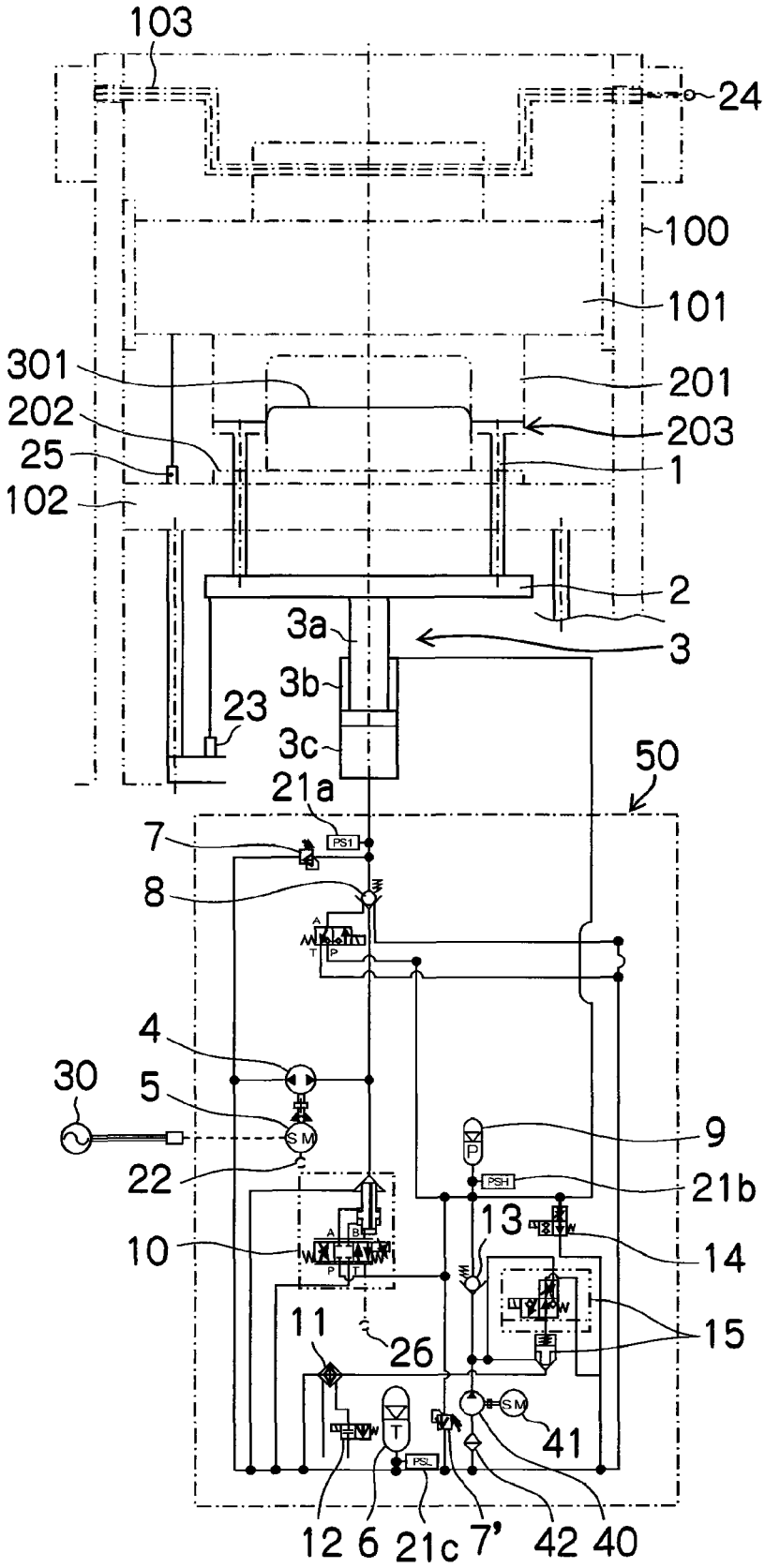
FIG. 1 is a diagram showing a structure of a first embodiment of a die cushion device for a press machine according to the present invention.
Figure 2:
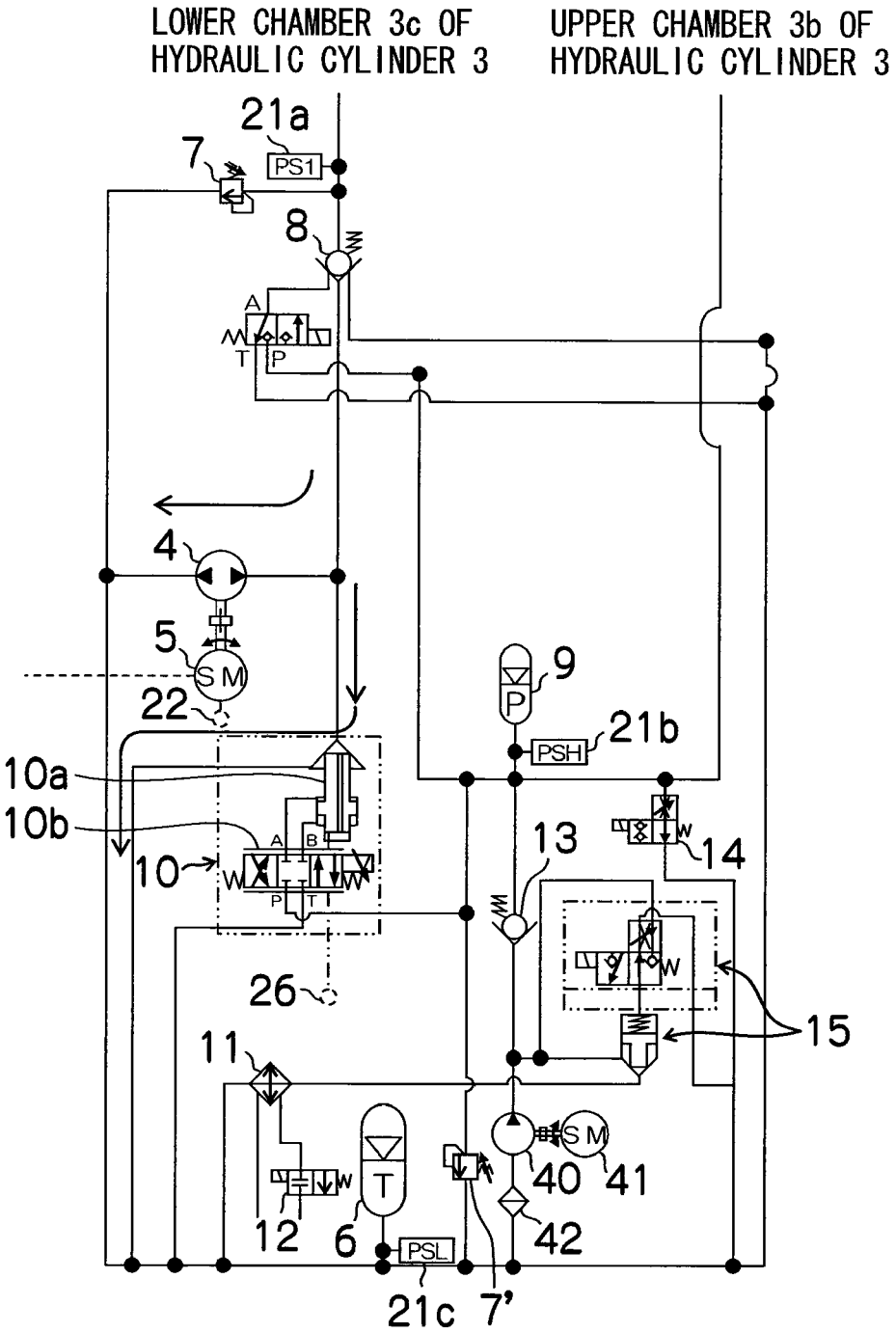
FIG. 2 is an enlarged view of the hydraulic circuit surrounded by the dot-and-dash line in FIG. 1.

FIG. 1 is a diagram showing the structure of a first embodiment of a die cushion device for a press machine according to the present invention. FIG. 2 is an enlarged view of a hydraulic circuit 50 surrounded by the dot-and-dash line in FIG. 1.

The press machine shown in FIG. 1 includes a frame (columns) 100, a slide 101, and a bolster (a bed) 102. The slide 101 is guided movably in a vertical direction by a guide unit placed in the frame 100. The slide 101 moves up and down in FIG. 1 by a crank mechanism including a crankshaft 103 through which a rotational drive force is transmitted by a drive unit not shown in the figure.

A slide position detector 25 that detects the position of the slide 101 is placed on a side of the bolster 102 of the press machine, and an angular velocity detector 24 that detects the angular velocity of the crankshaft 103 is provided to the crankshaft 103.

An upper mold 201 is attached the slide 101, and a lower mold 202 is provided to the bolster 102. The metal mold (the upper mold 201 and the lower mold 202) in this embodiment is used for molding a product 301 in a form of a hollow cup with closed top (a drawn shape).

A pad plate (blank holding plate) 203 is provided between the upper mold 201 and the lower mold 202. The lower portion of the pad plate 203 is supported by a cushion pad 2 via cushion pins 1, and a material is set on (in contact with) the upper portion of the pad plate 203. The cushion pad 2 is supported by a hydraulic cylinder 3, and a die cushion position detector 23 that detects the position of the cushion pad 2 is provided to the cushion pad 2 (or to the portion linked to the hydraulic cylinder or piston).

With the material (a disk-like plate in this example) being set on the pad plate 203 that is supported by the cushion pins 1 and stands by in a predetermined initial position, the slide 101 moves downward. At the point where the upper mold 201 is brought into contact with the product, pressing (drawing) of the product is started. Plastic working (deformation processing) is performed on the material between the upper mold 201 and the lower mold 202, and at the same time, the material is pressed from below and is supported via the cushion pins 1 and the pad plate 203 with a predetermined force required for preventing formation of wrinkles and cracks that are often formed in a radial direction of the disk-like material at the time of drawing. The force applied at this point is the die cushion pressure, and is constantly applied during the drawing process.

<Additional Remarks on the General Function of the Die Cushion>

Since the slide 101 collides with (or is impulsively brought into contact with) the material (and the pad plate 203) when the pressing is started, an impact force (a surge pressure on the hydraulic cylinder 3) is easily applied to the cushion pad 2. Since the impact force is larger than a predetermined die cushion pressure. Therefore, the molded product is broken, the metal mold is damaged, and the durability life of the machine is adversely affected (the die cushion device might be damaged in some cases).

<Description of the Die Cushion Device>

The die cushion device includes, as main components, the hydraulic cylinder 3 supporting the above described cushion pad 2, a proportional valve 10 and a hydraulic pump/motor 4 connected in parallel between a pressurizing chamber 3*c* (hereinafter referred to as the "lower chamber") of the cushion pressure generating side of the hydraulic cylinder 3 and a low-pressure source 6, an electric motor (a servomotor) 5 connected to the rotating shaft of the hydraulic pump/motor 4, a die cushion pressure command issuer 60 (see FIG. 4), a pressure detector 21*a* that detects a pressure in the lower chamber 3*c* of the hydraulic cylinder 3, and a controller 70 that controls an aperture of the proportional valve 10 and a torque of the electric motor 5 (see FIG. 3 and FIG. 4).

The piston rod 3*a* of the hydraulic cylinder 3 is linked to the cushion pad 2.

As shown in FIG. 2, the pressure detector 21*a* that detects the pressure in the lower chamber 3*c* is connected to a pipe connected to the lower chamber 3*c* of the hydraulic cylinder 3, and the proportional valve 10 and the hydraulic pump/motor 4 are connected to the pipe via a check valve 8 of a forced-release drive type.

Also, a safety valve (a relief valve) 7 is connected between the lower chamber 3*c* of the hydraulic cylinder 3 and the low-pressure source 6. The safety valve 7 is used for preventing damage in the hydraulic equipment when an abnormal pressure is generated (when the die cushion pressure cannot be controlled, and an abnormal pressure is generated in an unexpected fashion).

The pressure in an accumulating device used as the low-pressure source 6 is set at approximately 0.5 to 1 Mpa, and the accumulating device serves as a tank. The pressure in the low-pressure source 6 is detected by a pressure detector 21*c*.

Meanwhile, the pipe connected to the pressurizing chamber (hereinafter referred to as the "upper chamber") of the descending side of the hydraulic cylinder 3 is connected to an accumulating device 9. The pressure in the accumulating device 9 is detected by a pressure detector 21*b*.

The pressure oil discharged from a hydraulic pump 40 driven by an electric motor 41 is accumulated in the accumulating device 9 via a check valve 13. If the accumulation of pressure oil in the accumulating device 9 is sufficient, the hydraulic oil discharged from the hydraulic pump 40 circulates and is cooled in a hydraulic oil cooler 11 in a low-pressure state via an unloading operation valve 15.

If the pressure oil is released from the proportional valve 10 while the die cushion is operating, heat is generated by the throttling of the pressure oil, and therefore, the hydraulic oil needs cooling. Reference numeral 12 designates a water solenoid valve for supplying cooled water to the hydraulic oil cooler 11, and reference numeral 42 designates a filter.

The pressure oil accumulated in the accumulating device 9 is used as a pilot pressure for opening and closing a two-way valve 10*a* of the proportional valve 10, which includes the two-way valve 10*a* and an electromagnetic proportional flow control valve 10*b*, via the electromagnetic proportional flow control valve 10*b*. In addition, at the time of controlling (driving), the pressure oil accumulated in the accumulating device 9 is also used as the pilot pressure for forcibly opening a check valve 8 of the forced-release drive type which is a valve for preventing falling of the hydraulic cylinder 3 (or the cushion pad 2 coupled thereto) under the weight thereof at the time of non-controlling (non-driving). Further, the pressure oil accumulated in the accumulating device 9 is made to constantly act on the upper chamber 3*b* (the volume on the rod side) of the hydraulic cylinder 3, so as to facilitate up-and-down movement of the hydraulic cylinder 3 (or so that the hydraulic cylinder 3 can be moved up and down only through the torque of the electric motor 5).

A spool position detector 26 for detecting the aperture of the proportional valve is attached to the proportional valve 10, and an angular velocity detector 22 that detects the angular velocity of the electric motor 5 is provided to the motor shaft of the electric motor 5. Between the accumulating device 9 and the low-pressure source 6, there are lines which respectively connect a relief valve 7' and a magnetic orientation switching valve (a depressurization valve) 14.

[Principles of Die Cushion Pressure Control]

The die cushion pressure from the above described hydraulic cylinder 3 is generated by controlling the pressure in the lower chamber 3*c* of the hydraulic cylinder 3, that is, by controlling the aperture of the proportional valve 10 and the torque of the hydraulic pump/motor 4 that are respectively connected to the lower chamber 3*c* of the hydraulic cylinder 3.

The following is a description of the principles of the die cushion pressure control by the hydraulic cylinder 3.

Where the cross-sectional area of the hydraulic cylinder 3 on the die cushion pressure generating side is represented by A, the volume of the hydraulic cylinder 3 on the die cushion pressure generating side is represented by V, the die cushion pressure is represented by P, the torque of the electric motor 5 is represented by T, the inertia moment of the electric motor 5 is represented by I, the viscosity resistance coefficient of the electric motor 5 is represented by DM, the friction torque of the electric motor 5 is represented by fM, the displacement volume of the hydraulic pump/motor 4 is represented by Q, the force applied from the slide 101 onto the piston rod 3*a* of the hydraulic cylinder 3 is represented by F, the velocity of the cushion pad generated when the cushion pad is pushed by the press is represented by v, the inertia mass of the piston rod of the hydraulic cylinder 3 and the cushion pad is represented by M, the viscosity resistance coefficient of the hydraulic cylinder 3 is represented by DS, the friction force of the hydraulic cylinder 3 is represented by fS, the angular velocity of the servomotor rotating when pushed by the pressure oil is represented by ω, the modulus of volume elasticity of the hydraulic oil is represented by K, the proportional constants are represented by k1 and k2, the quantity of oil released by the proportional valve is represented by $q_v$, the amount of proportional valve commands is represented by R, and the proportional valve flow coefficient is represented by $C_v$, the static behaviors can be expressed by the following mathematical formulas (1) and (2):

$$P=\int K((v\cdot A-k1\,Q\cdot\omega-q_v)/V)dt \tag{1}$$

$$q_v=R\cdot C_v\sqrt{P} \tag{2}$$

$$T=k2\cdot PQ/(2\pi) \tag{3}$$

The dynamic behaviors can be expressed by the following mathematical formulas (4) and (5), as well as the mathematical formulas (1) and (2):

$$PA-F=M\cdot dv/dt+DS\cdot v+fS \tag{4}$$

$$T-k2\cdot PQ/(2\pi)=I\cdot d\omega/dt+DM\cdot\omega+fM \tag{5}$$

According to the above formulas (1) through (5), the force transmitted from the slide 101 to the piston rod 3*a* of the hydraulic cylinder 3 via the cushion pad 2 compresses the lower chamber 3*c* of the hydraulic cylinder 3 to generate the die cushion pressure.

While the die cushion pressure is maintained by the proportional valve 10, the oil is released (or the aperture is controlled). At the same time, the hydraulic pump/motor 4 is made to function as a hydraulic motor by the die cushion pressure. When the rotating shaft torque generated in the hydraulic pump/motor 4 is balanced with the drive torque of the electric motor 5, the electric motor 5 is rotated (or is made to function in a regenerative manner), to restrain increase in the pressure.

In short, the die cushion pressure is determined by the aperture of the proportional valve 10 and the drive torque of the electric motor 5.

At this point, to stably control a die cushion pressure value according to a set value which is preliminary set, the die cushion pressure P, the motor angular velocity ω, the cushion pad velocity v (or the press machine sliding velocity) generated as a result of the push by the press are detected, and are used for the compensation for determining the aperture of the proportional valve 10 and the torque of the electric motor 5. Also, the position of the die cushion is detected to control the product knockout operation. The position of the slide is detected to obtain the timing to activate the die cushion.

<Controller of the Die Cushion Device>

Figure 3:
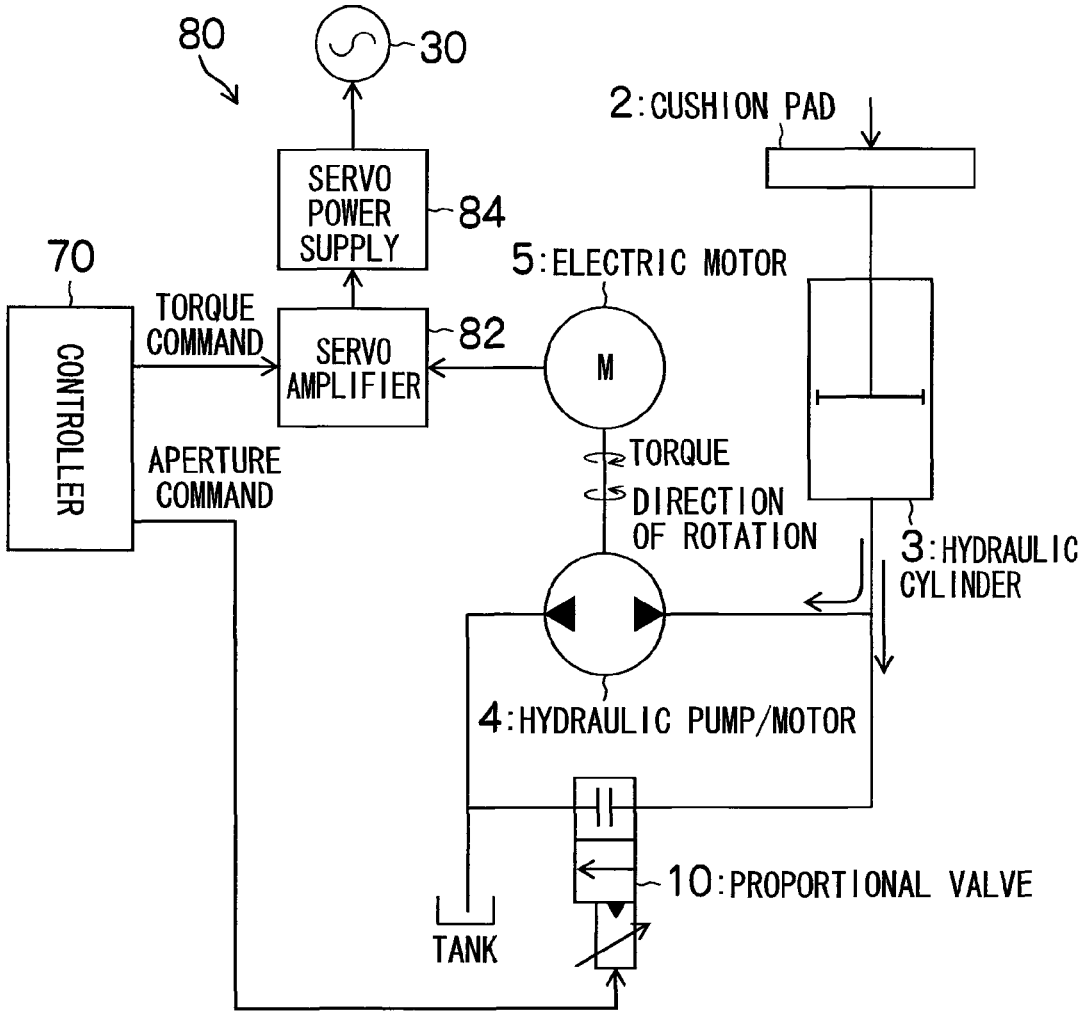
FIG. 3 is a schematic view of the die cushion device including a controller and a power regenerating unit.
Figure 4:
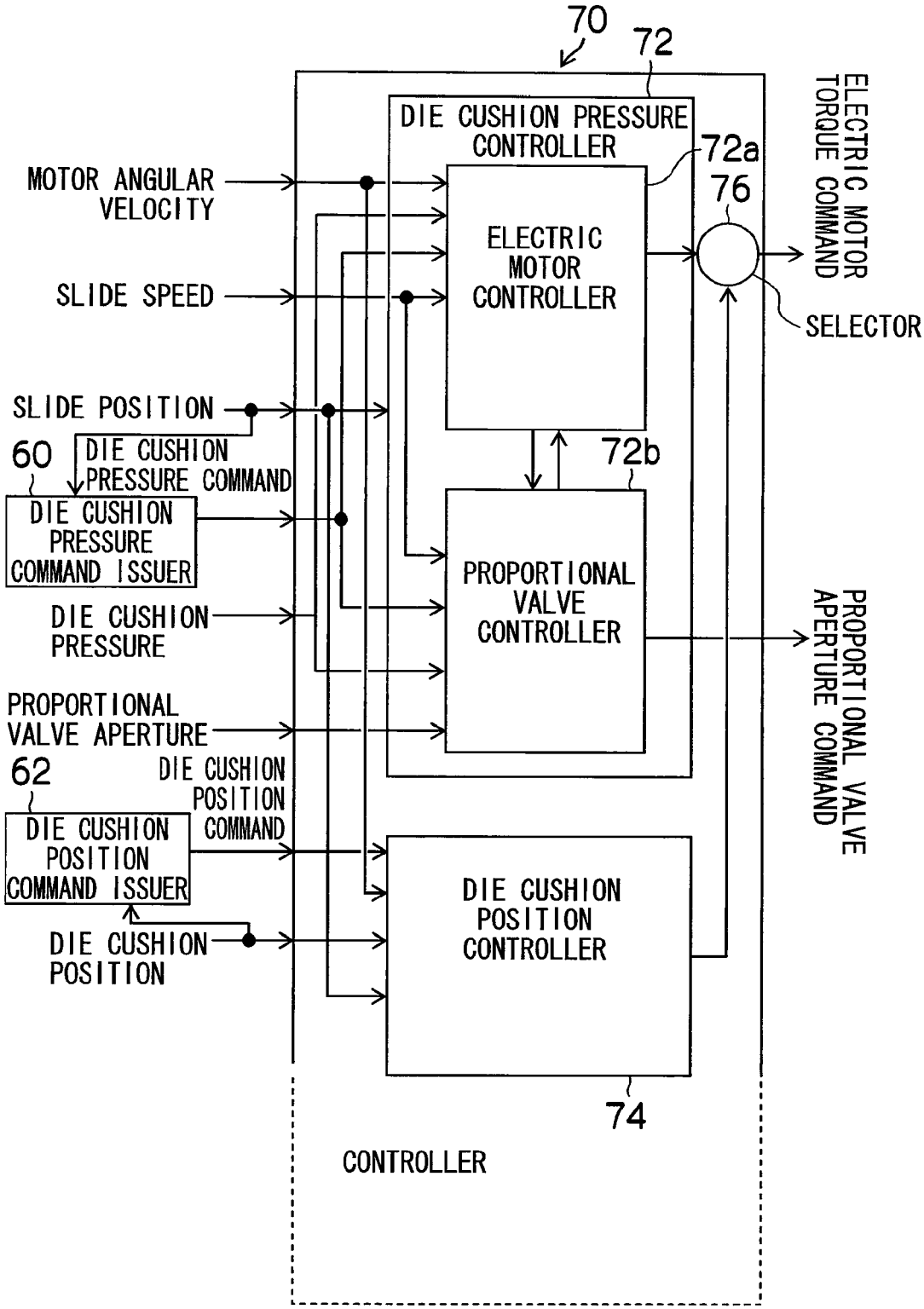
FIG. 4 is a block diagram showing the controller of FIG. 3 in greater detail.

FIG. 3 is a schematic view of the die cushion device including the controller 70 controlling the aperture of the proportional valve 10 and the torque of the electric motor 5, and a power regenerating unit 80, FIG. 4 is a block diagram specifically showing the controller 70.

As shown in FIG. 4, the controller 70 includes a die cushion pressure controller 72, a die cushion position controller 74, and a selector 76. The die cushion pressure controller 72 further includes an electric motor controller 72*a* and a proportional valve controller 72*b*.

A die cushion pressure value according to the position of the slide 101 is set beforehand in the die cushion pressure command issuer 60, and, based on a slide position signal detected by the slide position detector 25, the die cushion pressure command issuer 60 outputs a die cushion pressure command to the electric motor controller 72*a* and the proportional valve controller 72*b*.

Meanwhile, a signal indicating the die cushion position (or the cushion pad position) is supplied from the die cushion position detector 23 to a die cushion position command issuer 62, and is to be used for generating an initial value in generation of the position command value. After the slide 101 reaches a bottom dead point and the die cushion pressure control ends, the die cushion position command issuer 62 outputs a die cushion position command to control the die cushion position (or the position of the cushion pad 2), so that the product knockout operation is performed, and the cushion pad 2 is made to stand by in the initial position.

A slide position signal and a motor angular velocity signal are supplied from the slide position detector 25 and the angular velocity detector 22, respectively, to the die cushion pressure controller 72 and the die cushion position controller 74, and a slide speed signal about the slide 101 calculated from the angular velocity signal of the crankshaft 103 detected by the angular velocity detector 24 is also supplied to the die cushion pressure controller 72 and the die cushion position controller 74. Further, an angular velocity signal indicating the angular velocity of the electric motor 5 is supplied from the angular velocity detector 22 to the electric motor controller 72*a*, and a proportional valve aperture signal indicating the spool position (or the aperture) of the proportional valve 10 supplied from the spool position detector 26 is supplied to the proportional valve controller 72*b*.

Based on the above described various input signals, the controller 70 outputs an aperture command for controlling the aperture of the proportional valve 10, to the proportional valve 10. The controller 70 also outputs a torque command for controlling the torque of the electric motor 5, to the electric motor 5 via a servo amplifier 82 (see FIG. 3).

As described above, after the time of impact (or the time when the slide 101 is brought into direct or indirect contact with the cushion pad 2), a pressure is generated in the hydraulic cylinder 3 via the metal mold, the pad plate 203, the cushion pins 1, and the cushion pad 2, because of the power of the slide 101. The pressure oil pushed away (displaced) from the hydraulic cylinder 3 causes the hydraulic pump/motor 4 to function as a hydraulic motor, and pushes away (displaces) and causes the hydraulic pump/motor 4 to rotate. At this point, based on the input die cushion pressure command, the die cushion pressure signal detected by the pressure detector 21*a*, the slide velocity signal detected and calculated by the angular velocity detector 24 of the crankshaft 103, the angular velocity signal detected by the angular velocity detector 22 of the electric motor, and the like, the electric motor controller 72*a* causes the torque of the electric motor 5 to act on the pressurizing side, so as to generate a pressure (a die cushioning function). When the rotating shaft torque generated in the hydraulic pump/motor 4 is balanced with the drive torque of the electric motor 5, the electric motor controller 72*a* causes the electric motor 5 to rotate (a regenerating function). As shown in FIG. 3, the power generated by the electric motor 5 is regenerated in an alternating-current power supply via the servo amplifier 82 and a servo power supply 84 having a power regenerating function.

The pressure oil displaced from the hydraulic cylinder 3 is also released into the low-pressure source 6 (a tank) via the proportional valve 10. At this point, the proportional valve controller 72*b* controls the aperture and causes generation of the die cushion pressure, based on the input die cushion pressure command, the die cushion pressure signal detected by the pressure detector 21*a*, the slide velocity signal detected and calculated by the angular velocity detector 24 of the crankshaft, the proportional valve aperture signal detected by the spool position detector 26, and the like.

In a mechanical press of a crank or link mechanical type, the proportional valve controller 72*b* controls the aperture of the proportional valve 10, only when the production rate (the number of cycles/hour) is high, the slide position is higher than the bottom dead point, and the slide velocity is high. The proportional valve controller 72*b* does not control the aperture of the proportional valve 10 (an aperture 0=fully closed), when the production rate is low (the slide velocity is low in the entire cycles), or when the slide position is close to the bottom dead point though the production rate is high, and the slide velocity is low.

While the die cushion pressure control through the control of the torque of the electric motor 5 by the electric motor controller 72*a* and the die cushion pressure control through the control of the aperture of the proportional valve 10 by the proportional valve controller 72*b* are performed at the same time, the electric motor controller 72*a* and the proportional valve controller 72*b* control the torque of the electric motor 5 and the aperture of the proportional valve 10, respectively, so that the die cushion pressure being controlled through the cooperative control by the electric motor controller 72*a* and the proportional controller 72*b* become equal to the die cushion pressure indicated by the die cushion pressure command.

On the other hand, when the slide 101 reaches the bottom dead point (or when the press molding is completed), the controller 70 is switched from the die cushion pressure controlling state to a die cushion position controlling (maintaining) state.

In the die cushion position controlling state, the die cushion position controller 74 of the controller 70 outputs a torque command value calculated with the use of the die cushion position command input from the die cushion position command issuer 62, the die cushion position signal from the die cushion position detector 23, the angular velocity signal from the angular velocity detector 22, and the like, to the electric motor 5 via the selector 76.

At this point, the die cushion position controller 74 suspends the operation of the die cushion device for a predetermined period of time after the slide 101 starts moving upward, so that the product 301 is not damaged by interference among the slide 101, the product 301, and the die cushion device. After that, the hydraulic cylinder 3 (or the cushion pad 2) is moved upward to knock the molded product, which is closely attached to the lower mold 202, out of the lower mold 202. The hydraulic cylinder 3 is then returned to the initial position (the standby position), and waits for the next cycle. In the die cushion position controlling (maintaining) state, the proportional valve 10 is not used (a fully-closed state).

<Description of Procedures Through Operating Waveforms>

Figure 5:
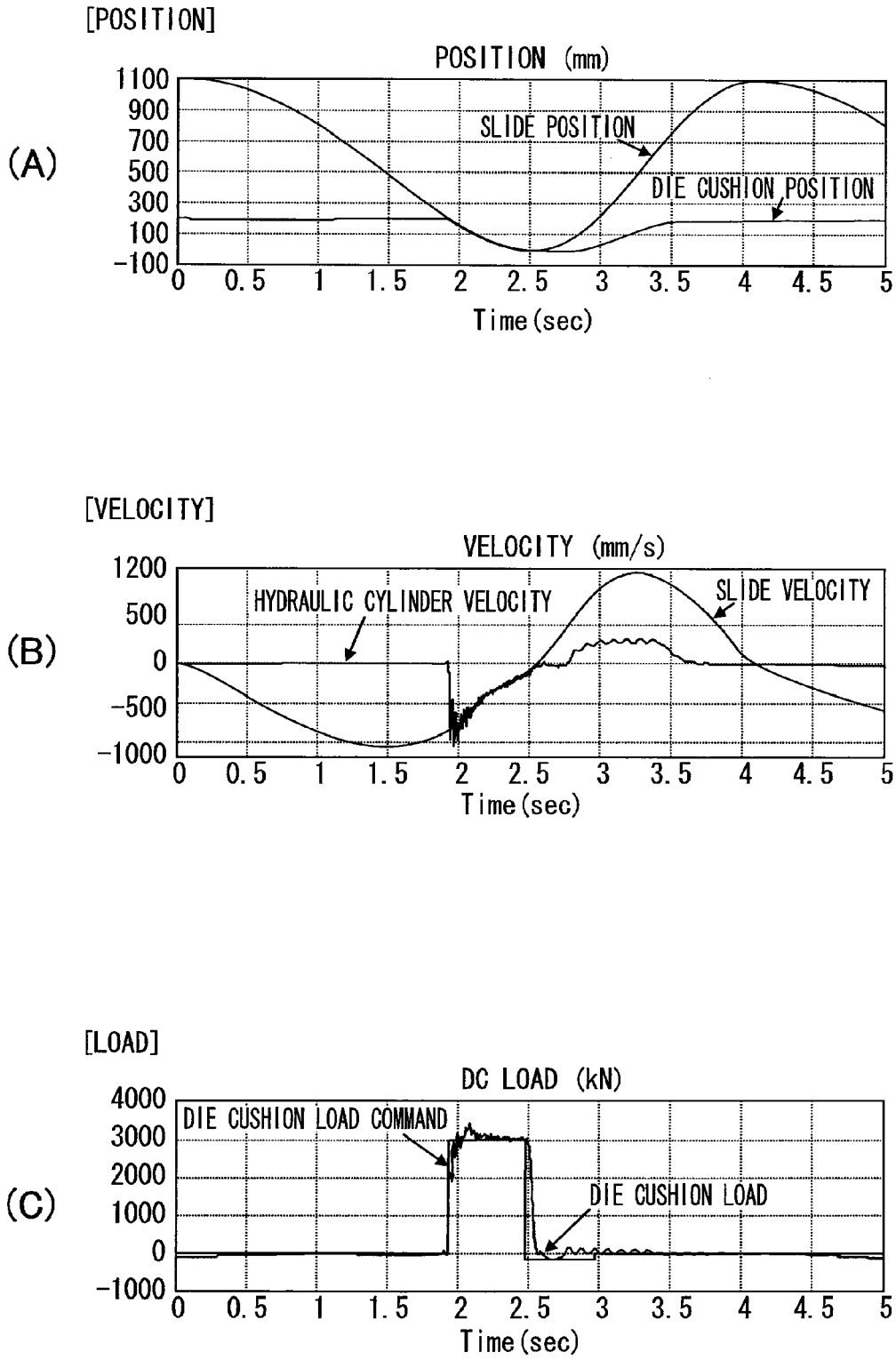
FIG. 5 shows waveform charts showing variations in the respective physical quantities of the position, velocity, and load (pressure) during a die cushion pressure operation in a case where the slide of the press machine is operated in one cycle as an example of a basic operation according to the present invention.
Figure 6:
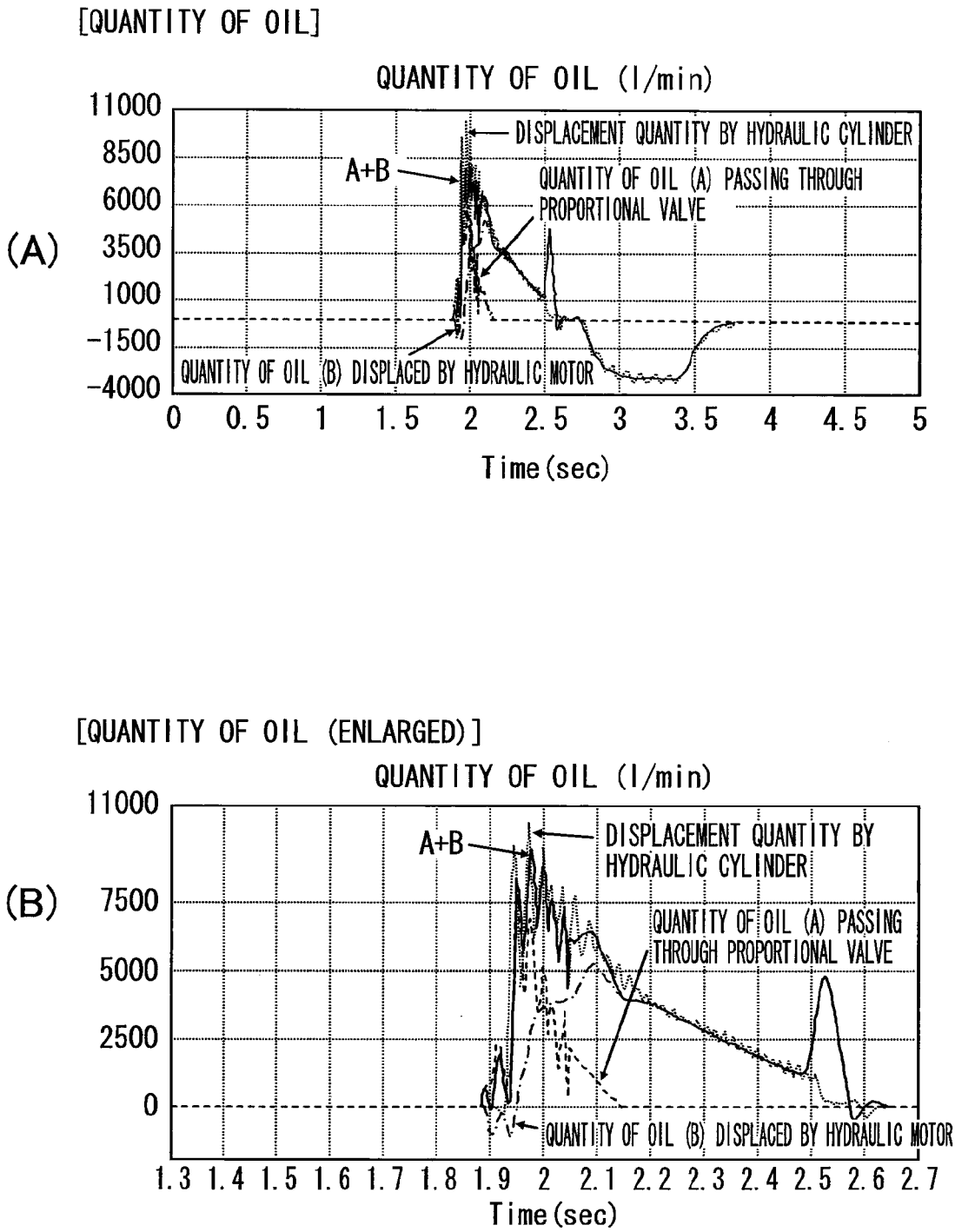
FIG. 6 shows waveform charts showing a variation in the quantity of oil during a die cushion pressure operation in a case where the slide of the press machine is operated in one cycle as an example of a basic operation according to the present invention.

FIG. 5 and FIG. 6 are waveform charts showing the variations in respective physical quantities caused by a die cushioning function when the slide of the press machine is operated in one cycle as an example of a basic operation according to the present invention.

In FIG. 5(A), while the slide 101 moves downward from the top dead point (1100 mm in FIG. 5(A)), the die cushion (the pad plate 203 and the cushion pad 2) stands by in the initial position (200 mm in FIG. 5(A)). As described above, the die cushion position controller 74 of the controller 70 controls (maintains) the position by outputting an electric motor torque command calculated with the use of the die cushion position command during the standby period, the die cushion position signal from the die cushion position detector 23, the motor angular velocity signal from the angular velocity detector 22, and the like, to the electric motor 5.

When the slide position signal from the slide position detector 25 reaches the die cushion initial position (or the vicinity thereof) as the slide 101 moves downward (an impact), the die cushion device switches from the die cushion position controlling (maintaining) state to the die cushion pressure controlling state.

In the initial stage in the die cushion pressure controlling state, the slide velocity at the point where the slide position reaches the die cushion initial position (150 mm) is approximately 850 mm/s (FIG. 5(B)), and the displacement volume of oil displaced by the hydraulic cylinder 3 exceeds the total displacement volume displaced by the hydraulic pump/motor 4 and the electric motor 5. Therefore, before the slide velocity becomes lower than 500 mm/s (until around 2.15 s) as the slide 101 further moves downward, the proportional valve 10 and the hydraulic pump/motor 4 are used in parallel, as shown in FIG. 6. In addition, part of the oil displaced from the hydraulic cylinder 3 is released to the low-pressure side by the proportional valve 10 while the die cushion pressure is secured (while throttling is performed), as shown in FIG. 3. Part (the remaining quantity) of the oil is pushed (displaced) and released to the low-pressure side via the hydraulic pump/motor 5 while the die cushion pressure is secured by the electric motor 5 (while the torque is applied in the opposite direction from the direction of rotation).

As shown in FIG. 4, the proportional valve 10 and the electric motor 5 control the die cushion pressure, based on the slide velocity (or the speed of the hydraulic cylinder 3), the die cushion pressure command, and the die cushion pressure signal. The proportional valve 10 also controls the die cushion pressure based on the proportional valve aperture signal (and an oil quantity signal indicating the quantity of oil passing through the proportional valve 10, if a flow rate detector is provided), and the electric motor 5 also controls the die cushion pressure, based on the motor angular velocity signal, while these two controllers compensate each other. In a case where the pressure oil is drawn out and released by the proportional valve 10, a dramatically larger volume of oil can be processed than in a case where the hydraulic pump/motor 4 pushes away (displaces) and releases pressure oil, though the proportional valve 10 is small in size (or has a compact exterior). Even if the slide velocity at the start of the die cushion pressure control becomes considerably higher than the slide velocity of this example (850 mm/s), the die cushion pressure control can be performed without any problems.

FIG. 6(A) is a waveform chart showing the change during one-cycle in the quantity of oil displaced by the hydraulic cylinder 3, the quantity of oil (A) passing through (released from) the proportional valve 10, and the quantity of oil (B) displaced by the hydraulic pump/motor 4. FIG. 6(B) is an enlarged view of the relevant part of the waveforms of FIG. 6(A).

In the example shown in FIG. 6(B), the largest displacement quantity (l/min) of oil by the hydraulic pump/motor 4 is almost half the largest displacement quantity (1/min) of oil by the hydraulic cylinder 3, and the quantity of oil equivalent to the difference of oil quantities passes through the proportional valve 10.

At the time of impact, control is performed beforehand to open the proportional valve 10. Therefore, most of the displacement quantity from the hydraulic cylinder 3 at the time of impact is discharged from the proportional valve 10. The displacement quantity of oil from the hydraulic cylinder 3 at the time of impact prevents the hydraulic pump/motor 4 and the electric motor 5 (the inertia moment) from being subjected to rapid angular acceleration, and accordingly, generation of a surge pressure can be prevented.

When the slide velocity becomes lower than 500 mm/s as the slide 101 moves downward, the displacement quantity from the hydraulic cylinder 3 is smaller than the sum of displacement volumes by the hydraulic pump/motor 4 and the electric motor 5. Accordingly, the electric motor 5 displaces and releases the oil only through the hydraulic pump/motor 4 while securing the die cushion pressure. It should be noted that, when the slide velocity becomes lower than 500 mm/s, the proportional valve 10 is maintained in a fully-closed state.

The electric motor 5 generates the die cushion pressure through a hydraulic motor function of the hydraulic pump/motor 4 as shown in FIG. 4. Therefore, the electric motor 5 applies a torque in the opposite direction from the direction of rotation (or has a power generating function), and the energy generated at this point is regenerated for a power supply.

Thereafter, molding (drawing) is performed until the slide 101 reaches the bottom dead point.

Since the molding comes to an end when the slide 101 reaches the bottom dead point, the die cushion pressure drops (becomes weaker) (in the neighborhood of 2.5 s in FIG. 5(C)).

When the drop in the die cushion pressure is completed, the control operation is switched from the die cushion pressure control to the die cushion position control (maintenance). In the die cushion position control operation, a torque command calculated with the use of the die cushion position command, the die cushion position signal from the die cushion position detector 23, and the like is output to the electric motor 5, as in the standby operation in the initial position. The position control is then performed to knock the product out of the mold and return the cushion pad 2 to the initial position (the standby position) (FIG. 5(A)).

Structure of Die Cushion Device

Second Embodiment

Figure 7:
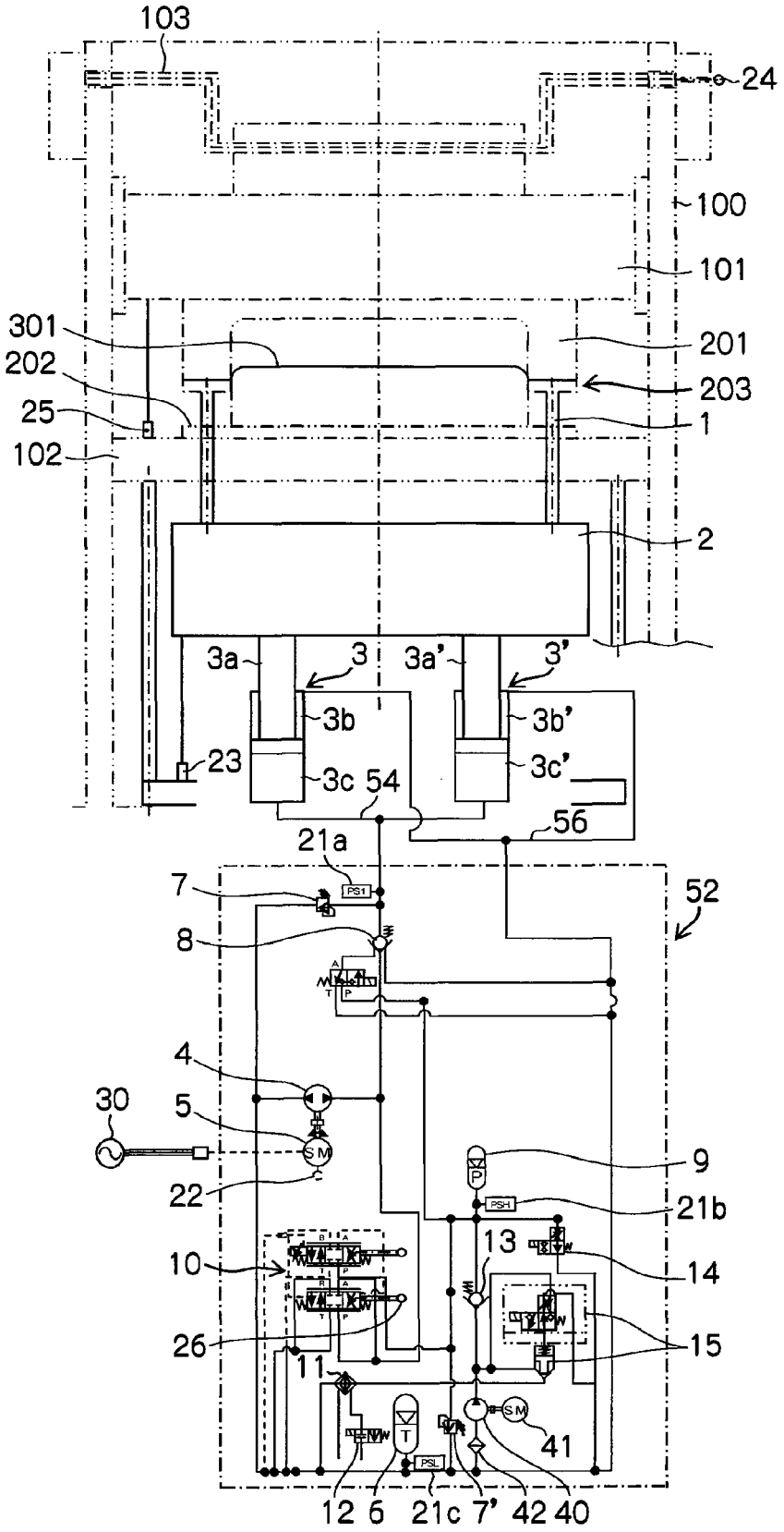
FIG. 7 is a diagram showing a structure of a second embodiment of a die cushion device for a press machine according to the present invention.
Figure 8:
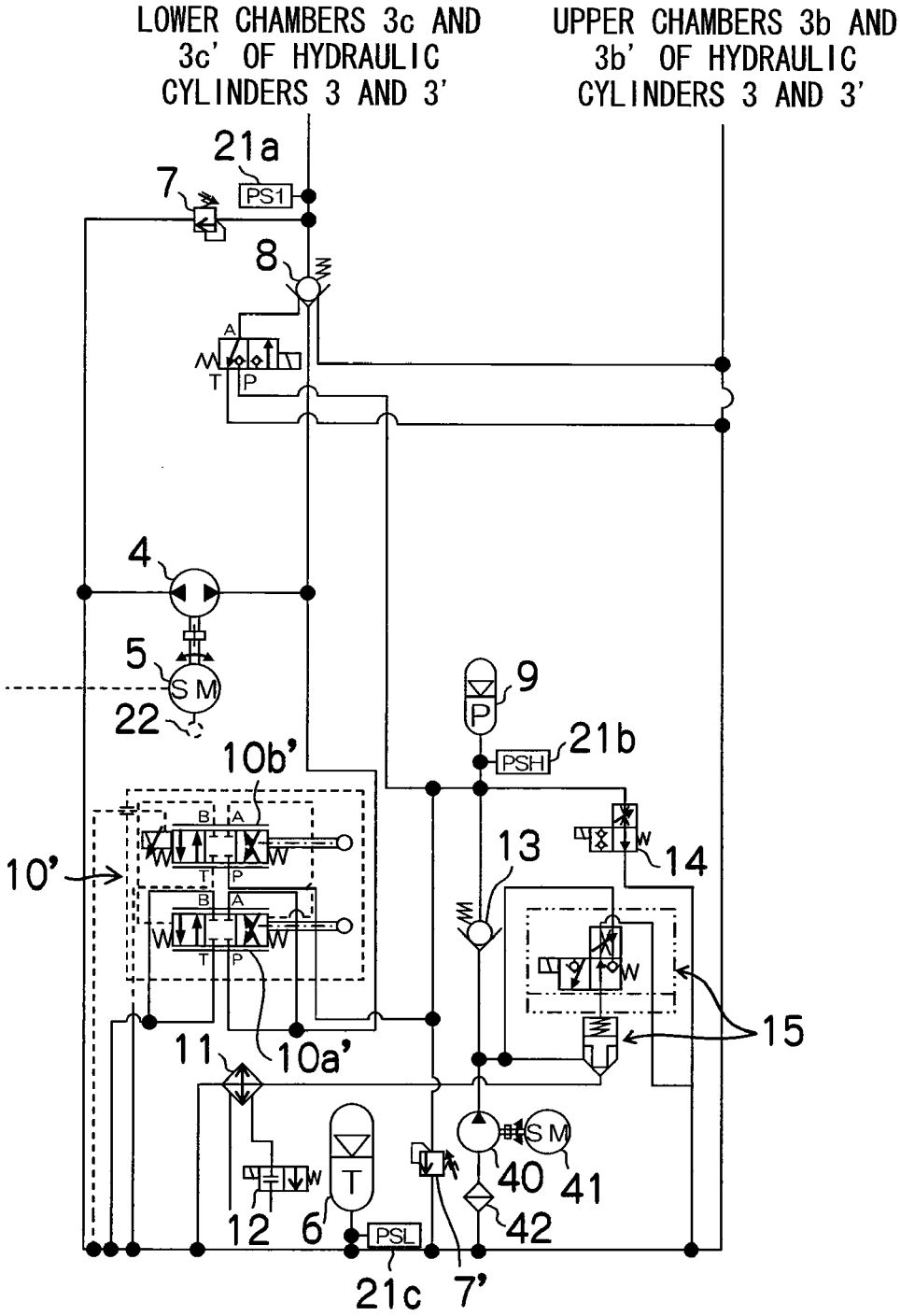
FIG. 8 is an enlarged view of the hydraulic circuit surrounded by the dot-and-dash line in FIG. 7.

FIG. 7 is a diagram showing the structure of a second embodiment of a die cushion device for a press machine according to the present invention. FIG. 8 is an enlarged view of the hydraulic circuit 52 surrounded by the dot-and-dash line in FIG. 7. It should be noted that, in FIG. 7 and FIG. 8, the same components as those of the first embodiment shown in FIG. 1 and FIG. 2 are denoted by the same reference numerals as those used in the first embodiment, and specific explanation of them will not be repeated herein.

The die cushion device of the second embodiment shown in FIG. 7 and FIG. 8 differs from the die cushion device of the first embodiment mainly in that the single hydraulic cylinder 3 is replaced with two hydraulic cylinders 3 and 3'.

That is, in the die cushion device of the second embodiment, the two hydraulic cylinders 3 and 3' are arranged in parallel with respect to the cushion pad 2. The lower chambers 3*c* and 3*c'* of those hydraulic cylinders 3 and 3' are connected by a shared pipe 54, and the upper chambers 3*b* and 3*b'* of the hydraulic cylinders 3 and 3' are connected by a shared pipe 56.

Also, as shown in FIG. 8, a proportional valve 10' includes a four-way valve 10*a'* and an electromagnetic proportional flow control valve 10*b'*.

With the functions of the configuration being taken into consideration, the proportional valve may be opened while the pressure oil is drawn from the high-pressure side to the low-pressure side. Although the two-way valve 10*a* shown in FIG. 2 may suffice, the four-way valve 10*a'* is of a type commonly used in the general public (more general), and such four-way valves are produced in large numbers. Accordingly, such a four-way valve is relatively inexpensive. Pressure oil ports are used in parallel (P→B+A→T, for example, as shown in FIG. 8), so as to secure a sufficient flow rate.

Also, in the die cushion device of the second embodiment, a pressure applied to the upper chambers 3*b* and 3*b'* (on the rod sides) of the hydraulic cylinders 3 and 3' is different from that in the first embodiment. While the relatively high pressure accumulated in the accumulating device 9 acts on the upper chamber 3*b* in the first embodiment, the low pressure of the low-pressure source 6 acts on the upper chambers 3*b* and 3*b'* in the second embodiment. Since the mass linked to the cushion pad 2 is large in the press machine of the second embodiment, the force of gravity serves as the power for lowering the cushion pad 2.

In both the first and second embodiments, the power for lowering the cushion pad 2 is constantly applied during regular operations, and the movement switching between descending and ascending can be performed only through the torque of the hydraulic pump/motor 4, without an operation to switch valves or the like.

Structure of Die Cushion Device

Third Embodiment

Figure 9:
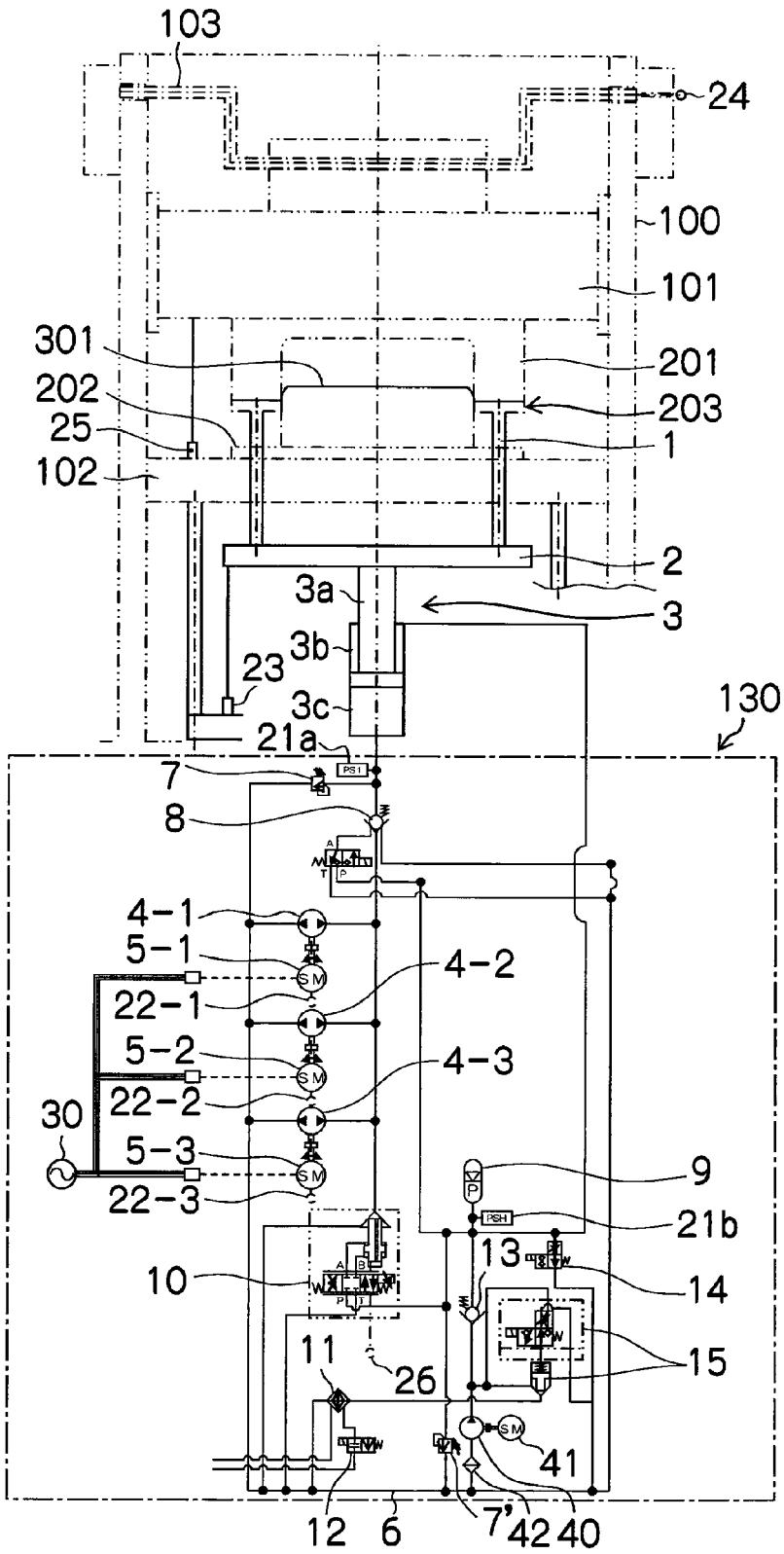
FIG. 9 is a diagram showing a structure of a third embodiment of a die cushion device for a press machine according to the present invention.
Figure 13:
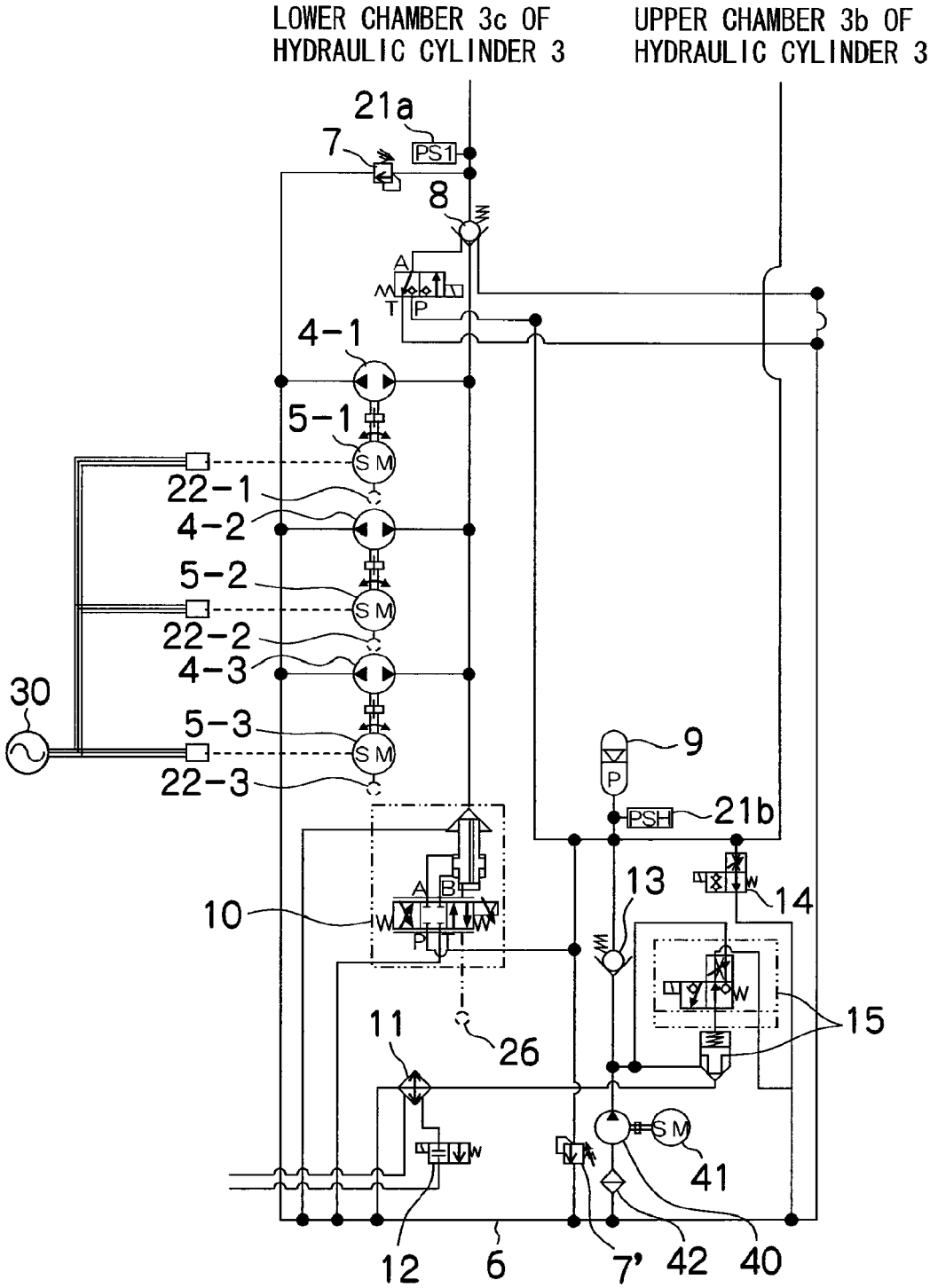
FIG. 13 is an enlarged view of the hydraulic circuit surrounded by the dot-and-dash line in FIG. 9.

FIG. 9 is a diagram showing the structure of a third embodiment of a die cushion device for a press machine according to the present invention. FIG. 13 is an enlarged view of the hydraulic circuit 130 surrounded by the dot-and-dash line in FIG. 9. It should be noted that the same components as those of the first embodiment shown in FIG. 1 are denoted by the same reference numerals as those used in the first embodiment, and specific explanation of them will not be repeated herein.

In the die cushion device of the third embodiment shown in FIG. 9 and FIG. 13, three hydraulic pumps/motors 4-1, 4-2, and 4-3 are arranged in parallel between the lower chamber 3*c* of the hydraulic cylinder 3 and the low-pressure source 6 via branch pipes. Electric motors 5-1, 5-2, and 5-3 are connected to the rotating shafts of the hydraulic pumps/motors 4-1, 4-2, and 4-3, respectively. Angular velocity detectors 22-1, 22-2, and 22-3 are provided to the rotating shafts of the electric motors 5-1, 5-2, and 5-3, respectively.

The torque control of the electric motors 5-1, 5-2, and 5-3 is performed in the same manner as the torque control of the single electric motor 5 of the first embodiment. However, the capacity of those electric motors 5-1, 5-2, and 5-3 can be one third of the capacity of the single electric motor 5.

Structure of Die Cushion Device

Fourth Embodiment

Figure 10:
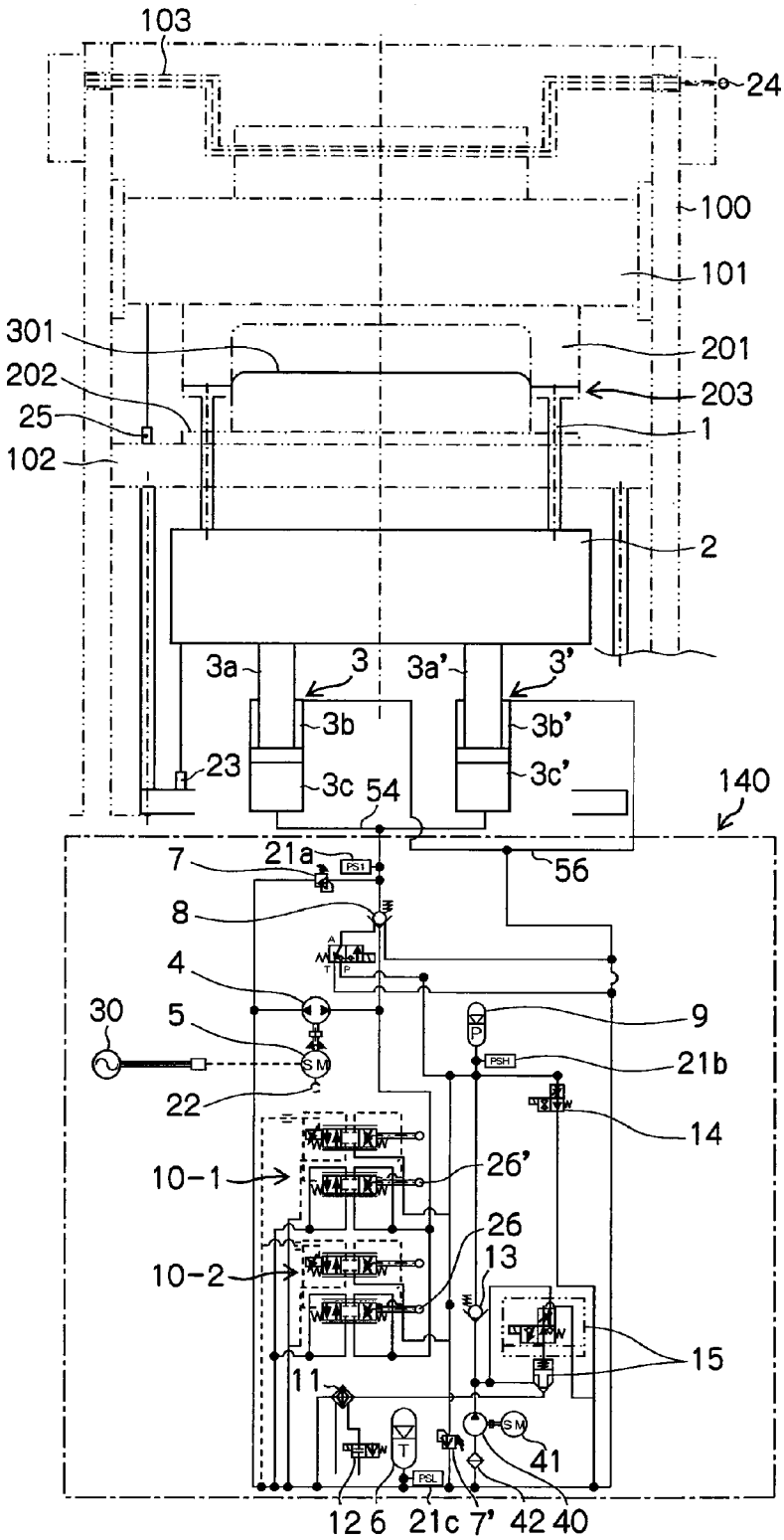
FIG. 10 is a diagram showing a structure of a fourth embodiment of a die cushion device for a press machine according to the present invention.
Figure 14:
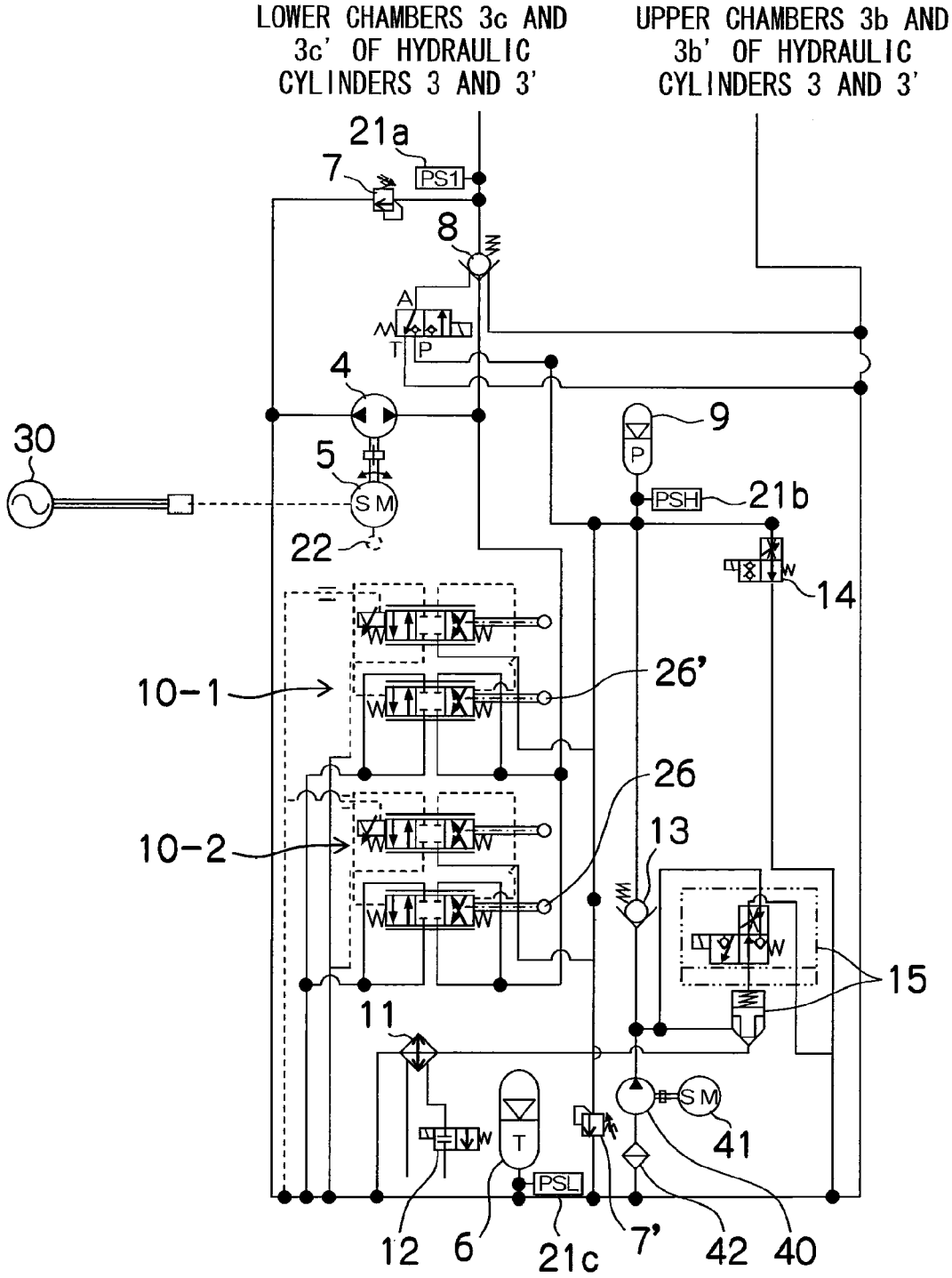
FIG. 14 is an enlarged view of the hydraulic circuit surrounded by the dot-and-dash line in FIG. 10.

FIG. 10 is a diagram showing the structure of a fourth embodiment of a die cushion device for a press machine according to the present invention. FIG. 14 is an enlarged view of the hydraulic circuit 140 surrounded by the dot-and-dash line in FIG. 10. It should be noted, that the same components as those of the second embodiment shown in FIG. 7 are denoted by the same reference numerals as those used in the second embodiment, and specific explanation of them will not be repeated herein.

The die cushion device of the fourth embodiment shown in FIG. 10 and FIG. 14 differs from that of the second embodiment in that two proportional valves 10-1 and 10-2 are arranged in parallel between the low-pressure source 6 and the shared pipe 54 connecting the lower chambers 3*c* and 3*c'* of the hydraulic cylinders 3 and 3', via branch pipes.

The control of the apertures of the respective proportional valves 10-1 and 10-2 is performed in the same manner as the control of the aperture of the single proportional valve 10' of the second embodiment. However, the quantity of oil flowing through each of the proportional valves 10-1 and 10-2 is a half of that flowing through the single proportional valve 10'.

Structure of Die Cushion Device

Fifth Embodiment

Figure 11:
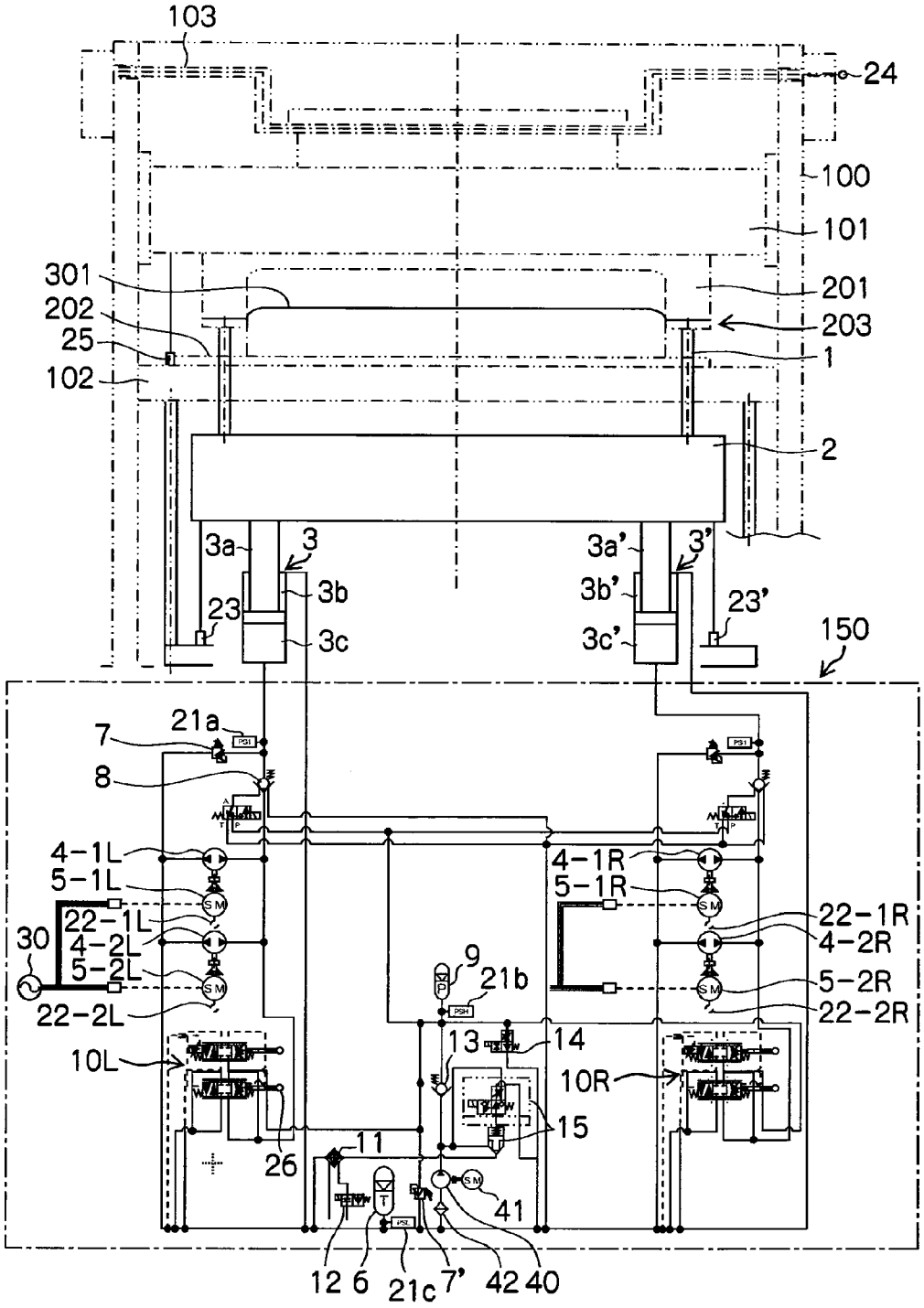
FIG. 11 is a diagram showing a structure of a fifth embodiment of a die cushion device for a press machine according to the present invention.
Figure 15:
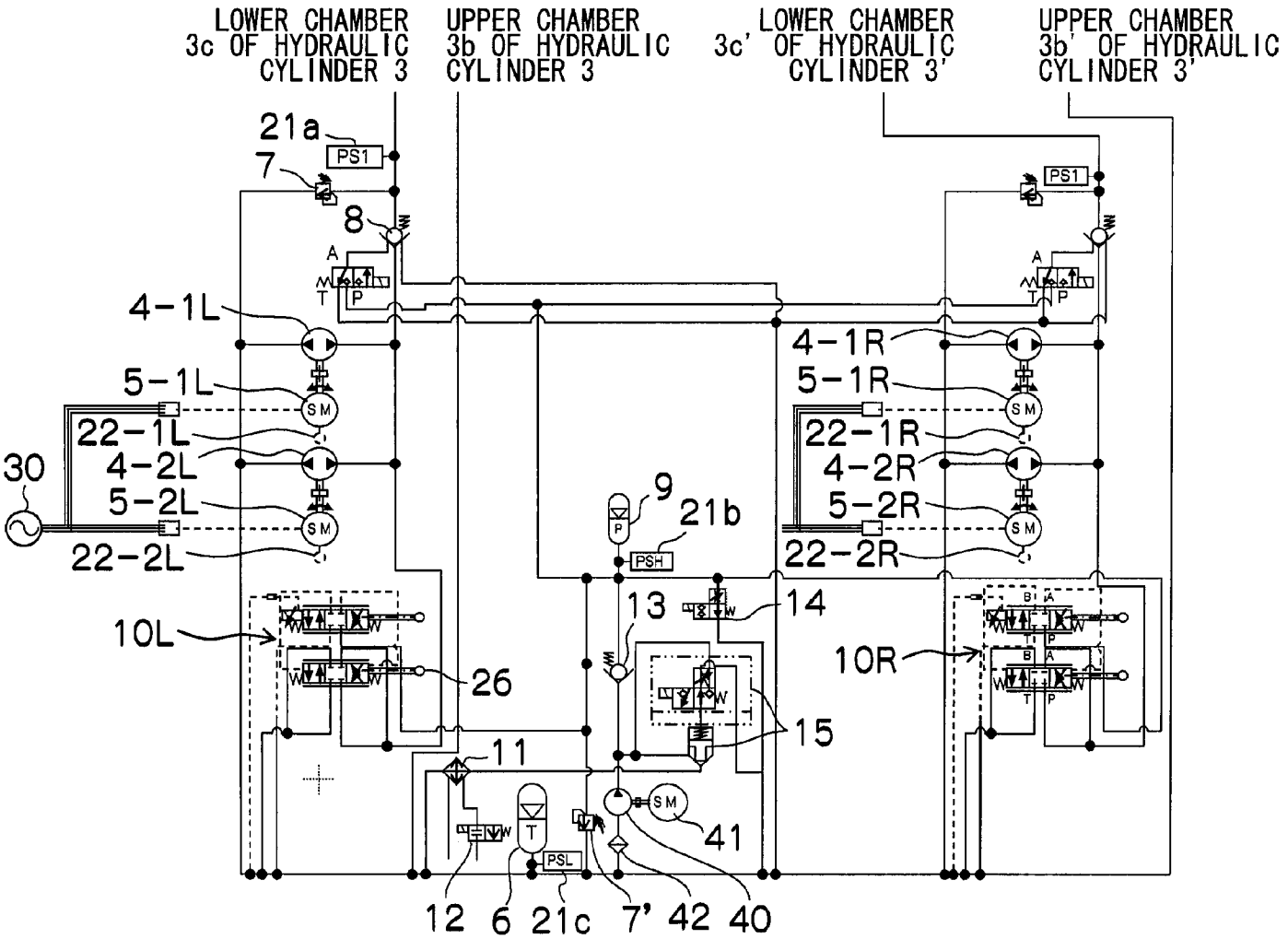
FIG. 15 is an enlarged view of the hydraulic circuit surrounded by the dot-and-dash line in FIG. 11.

FIG. 11 is a diagram showing the structure of a fifth embodiment of a die cushion device for a press machine according to the present invention. FIG. 15 is an enlarged view of the hydraulic circuit 150 surrounded by the dot-and-dash line in FIG. 11. It should be noted that the same components as those of the second embodiment shown in FIG. 7 are denoted by the same reference numerals as those used in the second embodiment, and specific explanation of them will not be repeated herein.

In the die cushion device of the second embodiment shown in FIG. 7, the lower chambers 3*c* and 3*c'* of the hydraulic cylinders 3 and 3' arranged to the left and right of the cushion pad 2 are connected by the shared pipe 54, and the aperture of the proportional valve 10' and the torque of the electric motor 5 are controlled in the same manner as in a case where the single hydraulic cylinder 3 is controlled. However, the die cushion position of the fifth embodiment shown in FIG. 11 and FIG. 15 differs from that of the second embodiment of a single line in that the left and right hydraulic cylinders 3 and 3' are controlled independently of each other, and the die cushion device is a two-line die cushion device having the left and right lines.

More specifically, hydraulic pumps/motors (two hydraulic pumps/motors 4-1L and 4-2L arranged in parallel) and a proportional valve 10L are arranged in parallel between the lower chamber 3*c* of the hydraulic cylinder 3 and the low-pressure source 6, and hydraulic pumps/motors (two hydraulic pumps/motors 4-1R and 4-2R arranged in parallel) and a proportional valve 10R are arranged in parallel between the lower chamber 3*c*' of the other hydraulic cylinder 3' and the low-pressure source 6.

Electric motors 5-1L, 5-2L, 5-1R and 5-2R are connected to the rotating shafts of the hydraulic pumps/motors 4-1L, 4-2L, 4-1R and 4-2R, respectively, and angular velocity detectors 22-1L, 22-2L, 22-1R and 22-2R are provided to the rotating shafts of the electric motors 5-1L, 5-2L, 5-1R and 5-2R, respectively.

Along with the left and right hydraulic cylinders 3 and 3', die cushion position detectors 23 and 23' that detect the left and right positions of the cushion pad 2 are also provided, and pressure detectors 21*a* and 21*a*' that detect the pressures of the lower chambers 3*c* and 3*c*' of the left and right hydraulic cylinders 3 and 3' are further provided.

The pressures of the left and right hydraulic cylinders 3 and 3' are controlled by driving the electric motors 5-1L, 5-2L, 5-1R and 5-2R, and the proportional valves 10L and 10R of the respective hydraulic cylinders.

Figure 12:
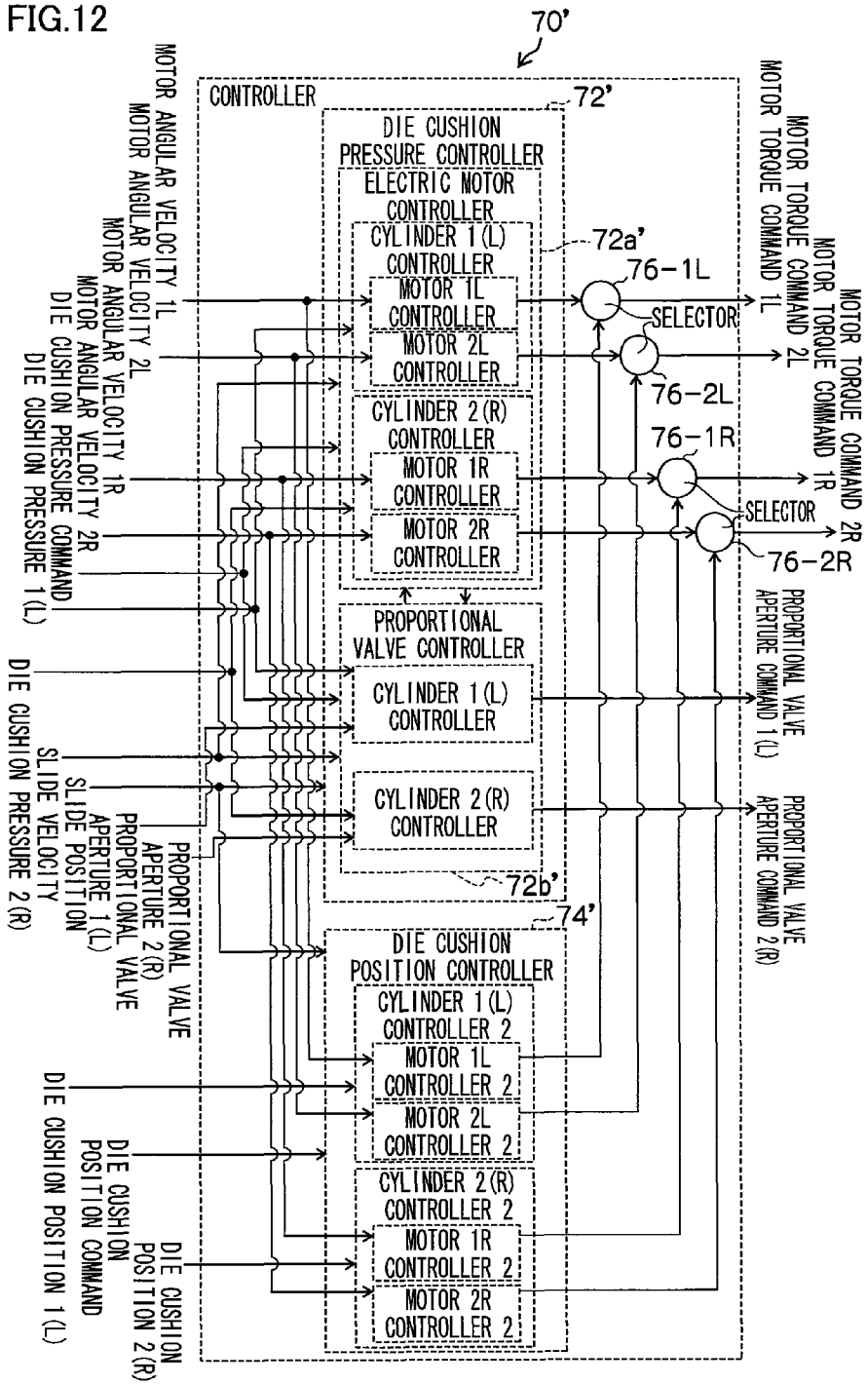
FIG. 12 is a block diagram showing the controller of the die cushion device shown in FIG. 11.

FIG. 12 is a block diagram showing an embodiment of the controller of the die cushion device having the above described structure.

This controller 70' includes a die cushion pressure controller 72', a die cushion position controller 74', and selectors 76-1L, 76-2L, 76-R, and 76-2R. The die cushion pressure controller 72' further includes an electric motor controller 72*a*' and a proportional valve controller 72*b*'. The controller 70' has the same structure as the controller 70 shown in FIG. 4.

The controller 70 shown in FIG. 4 receives a single motor angular velocity signal, a single die cushion pressure signal, a single proportional valve aperture signal, and a single die cushion position signal, and generates and outputs a single electric motor torque command and a single proportional valve aperture command. On the other hand, the controller 70' shown in FIG. 12 receives four motor angular velocity signals 1L, 1R, 2L and 2R, two die cushion pressure signals 1(L) and 2(R), two proportional valve aperture signals 1(L) and 2(R), and two die cushion position signals 1(L) and 2(R), and generates and respectively outputs electric motor torque commands 1L, 2L, 1R, and 2R to the four electric motors 5-1L, 5-2L 5-1R, and 5-2R. The controller 70' also generates and outputs respective proportional valve aperture commands 1(L) and 2(R) for the two proportional valves 10L and 10R.

In the die cushion device of the fifth embodiment, the left and right hydraulic cylinders 3 and 3' attached to the cushion pad 2 are controlled independently of each other. Accordingly, a horizontally long cushion pad can be operated (moved upward and downward) in a horizontal state, for example. Also, the respective devices (such as the hydraulic pumps/motors, the electric motors, and the proportional valves) in each of the left and right lines can be formed by small-sized devices.

[Modification]

Although example cases where oil is used as the operating fluid of a die cushion device have been described in the above embodiments, the present invention is not limited to them, and water or some other fluid may be used. That is, in the embodiments, hydraulic cylinders and hydraulic pumps utilizing oil are used. However, the present invention is not limited to them, and it is of course possible to use hydraulic cylinders and hydraulic pumps utilizing water or some other fluid. Also, the die cushion device according to the present invention can be used not only for crank presses, but also for various kinds of press machines including mechanical presses.

The hydraulic cylinder(s) provided to the cushion pad are not limited to those of the above described embodiments. For example, two hydraulic cylinders may be provided at a front portion and a rear portion of the cushion pad, or four hydraulic cylinders may be provided at a front portion, a rear portion, a left portion, and a right portion of the cushion pad.

Further, the present invention is not limited to the above described examples, and various changes and modifications may of course be made to them without departing from the scope of the invention.

REFERENCE SIGNS LIST

1 . . . cushion pins, 2 . . . cushion pad, 3, 3' . . . hydraulic cylinders, 4, 4', 4-1, 4-2, 4-3, 4-1L, 4-1R, 4-2L, 4-2R . . . hydraulic pumps/motors, 5, 5', 5-1, 5-2, 5-3, 5-1L, 5-1R, 5-2L, 5-2R . . . electric motors, 6 . . . low-pressure source, 9 . . . accumulating device, 10, 10', 10-1, 10-2, 10L, 10R . . . proportional valves, 21*a*, 21*a*' . . . pressure detectors, 22, 22-1, 22-2, 22-3 . . . angular velocity detectors, 23, 23' . . . die cushion position detectors, 25 . . . slide position detector, 26 . . . spool position detector, 30 . . . alternating-current power supply, 54, 56 . . . shared pipes, 60 . . . die cushion pressure command issuer, 62 . . . die cushion position command issuer, 70, 70' . . . controllers, 72, 72' . . . die cushion pressure controllers, 72*a*, 72*a*' . . . electric motor controllers, 72*b*, 72*b*' . . . proportional valve controllers, 74, 74' . . . die cushion position controllers, 76, 76-1L, 76-2L, 76-1R, 76-2R . . . selectors, 80 . . . power regenerating unit, 82 . . . servo amplifier, 84 . . . servo power supply, 100, frame (columns), 101 . . . slide, 102 . . . bolster, 201 . . . upper mold, 202 . . . lower mold, 203 . . . pad plate, 301 . . . product

The invention claimed is:

1. A die cushion device for a press machine, the die cushion device comprising:

a hydraulic cylinder supporting a cushion pad and generating a die cushion pressure when a slide of the press machine moves downward, the hydraulic cylinder including a lower chamber in which a cushion pressure is generated;

a proportional valve and a hydraulic pump and motor connected in parallel between the lower chamber of the hydraulic cylinder and a low-pressure source;

an electric motor connected to a rotating shaft of the hydraulic pump and motor;

a die cushion pressure command issuer outputting a die cushion pressure command;

a pressure detector detecting a pressure in the lower chamber of the hydraulic cylinder; and a controller configured to control an aperture of the proportional valve and a torque of the electric motor in a manner that the die cushion pressure becomes equal to a pressure corresponding to the die cushion pressure command, based on the die cushion pressure command and the pressure detected by the pressure detector.

2. The die cushion device for the press machine according to claim 1, further comprising a regenerating unit regenerating an energy applied to the hydraulic cylinder when the press machine executes die cushioning function, the energy being used for the die cushioning function, as an electric energy via the hydraulic pump and motor and the electric motor.

3. The die cushion device for the press machine according to claim 1, further comprising a slide velocity detecting device detecting a velocity of the slide, wherein the controller controls the proportional valve based on the velocity detected by the slide velocity detecting device when the velocity is larger than a certain value at a time of performing die cushioning function of the press machine, and releases part of a pressure liquid displaced from the hydraulic cylinder to the low-pressure source via the proportional valve.

4. The die cushion device for the press machine according to claim 3, wherein the controller controls the aperture of the proportional valve at the time of performing the die cushioning function of the press machine, based on the die cushion pressure command, the pressure detected by the pressure detector, and the velocity detected by the slide velocity detecting device.

5. The die cushion device for the press machine according to claim 1, further comprising:

a slide velocity detecting device detecting a velocity of the slide; and an angular velocity detector detecting an angular velocity of one of the hydraulic pump and motor and the electric motor, wherein the controller controls the torque of the electric motor at a time of performing a die cushioning function of the press machine in a manner that the die cushion pressure becomes equal to the pressure corresponding to the die cushion pressure command, based on the die cushion pressure command, the pressure detected by the pressure detector, the velocity detected by the slide velocity detecting device, and the angular velocity detected by the angular velocity detector.

6. The die cushion device for the press machine according to claim 1, further comprising a slide position detector detecting a position of the slide, wherein the die cushion pressure command issuer outputs the die cushion pressure command, based on the slide position detected by the slide position detector.

7. The die cushion device for the press machine according to claim 1, further comprising a die cushion position detector detecting a position of the cushion pad, wherein the controller uses a die cushion position signal detected by the die cushion position detector as a position feedback signal for controlling the electric motor when a product knockout operation is performed or the hydraulic cylinder is independently moved upward or downward.

8. The die cushion device for the press machine according to claim 1, wherein the hydraulic cylinder includes a plurality of hydraulic cylinders arranged in parallel with respect to the cushion pad, and the proportional valve and the hydraulic pump and motor are connected to lower chambers of the respective hydraulic cylinders via a shared pipe.

9. The die cushion device for the press machine according to claim 1, wherein the hydraulic pump and motor includes a plurality of hydraulic pumps and motors each having a pressure liquid supplied from the lower chamber of the hydraulic cylinder via a branch pipe, and the electric motor includes a plurality of electric motors respectively connected to the plurality of hydraulic pumps and motors and subjected to torque control.

10. The die cushion device for the press machine according to claim 1, wherein the proportional valve includes a plurality of proportional valves to each of which a pressure liquid is provided from the lower chamber of the hydraulic cylinder via a branch pipe, and an aperture of each of the proportional valves is controlled.

11. The die cushion device for the press machine according to claim 1, wherein a plurality of sets of the hydraulic cylinder, the proportional valve, the hydraulic pump and motor, the electric motor, and the pressure detector are provided for the single cushion pad.

12. The die cushion device for the press machine according to claim 11, further comprising a slide velocity detecting device detecting a velocity of the slide, wherein the controller individually controls an aperture of the proportional valve for each hydraulic cylinder at a time of performing die cushioning function of the press machine, based on the die cushion pressure command, the pressure detected by the pressure detector, and the velocity detected by the slide velocity detecting device.

13. The die cushion device for the press machine according to claim 11, further comprising:

a slide velocity detecting device detecting a velocity of the slide; and a plurality of angular velocity detectors detecting respective angular velocities of the hydraulic pumps and motors or the electric motors, wherein the controller controls a torque of each of the electric motors at a time of performing die cushioning function of the press machine in a manner that the die cushion pressure in each of the hydraulic cylinders becomes equal to the pressure corresponding to the die cushion pressure command, based on the die cushion pressure command, the velocity detected by the slide velocity detecting device, the respective pressures detected by the pressure detectors, and the respective angular velocities detected by the angular velocity detectors.

14. The die cushion device for the press machine according to claim 11, further comprising a plurality of die cushion position detectors for the respective hydraulic cylinders, the die cushion position detectors detecting the position of the cushion pad, wherein the controller uses respective die cushion position signals detected by the die cushion position detectors as position feedback signals for controlling respective the electric motors driving the corresponding hydraulic cylinders, when a product knockout operation is performed or each of the hydraulic cylinders is independently moved upward or downward.

* * * * *